United States Patent [19]

Sprowls, III

[11] 4,067,008

[45] Jan. 3, 1978

[54] MULTIPLEX INTERROGATION SYSTEM USING PULSES

[75] Inventor: Joseph B. Sprowls, III, Broomfield, Colo.

[73] Assignee: Denver Fire Reporter & Protective Co., Inc., Denver, Colo.

[21] Appl. No.: 644,913

[22] Filed: Dec. 29, 1975

[51] Int. Cl.[2] ..... G08B 29/00

[52] U.S. Cl. ..... 340/409; 340/408; 340/150; 340/413; 340/152 T

[58] Field of Search ..... 340/408, 409, 152 T, 340/413, 412, 147 R, 150, 146.1 C, 146.1 BA

[56] References Cited

U.S. PATENT DOCUMENTS

| | | | |
|---|---|---|---|
| 3,508,260 | 4/1970 | Stein | 340/408 |
| 3,613,092 | 10/1971 | Schumann | 340/413 |
| 3,676,878 | 7/1972 | Linder | 340/408 |
| 3,689,887 | 9/1972 | La Falce et al. | 340/409 |
| 3,713,142 | 1/1973 | Getchell | 340/408 |
| 3,737,858 | 6/1973 | Turner et al. | 340/151 |
| 3,876,980 | 4/1975 | Haemmig et al. | 340/146.1 BA |
| 3,922,492 | 11/1975 | Lumsden | 340/152 T |
| 3,932,858 | 1/1976 | Smith et al. | 340/408 |
| 3,952,285 | 4/1976 | Falck | 340/152 T |

*Primary Examiner*—John W. Caldwell
*Assistant Examiner*—Donnie L. Crosland
*Attorney, Agent, or Firm*—Max L. Wymore

[57] ABSTRACT

This interrogation system monitors the status of a plurality of protection zone transducers by repeatedly supplying a series of sequential interrogation pulses thereto sufficient to address and scan every transducer associated with a protection zone. Reply pulses are received from a transponder associated with a protection zone transducer and the reply pulses received over a selected number of prior sequential scans form a response pattern from which the condition of each transducer and its protection zone is determined. At least three conditions may be determined from the reply response pattern, including an alarm condition, a normal condition, and an out-of-service condition. Information relative to each transducer and its respective protection zone is stored in the form of bits at memory addresses corresponding to the count of the protection zone transducer from which that information is received. Provision is made for synchronizing the transducers associated with the respective protection zones to the count of interrogation pulses delivered thereto to thereby maintain accurate correlation and integrity between the protection zones addressed and the reply pulses received. The interrogation and reply pulses are preferably direct voltage pulses and the system is compatible for use with connection to a standard telephone line system. Information in the form of a visual indication and printed record may be provided relative to the status, function and number of a selected transponder and the condition of its protection zone.

15 Claims, 19 Drawing Figures

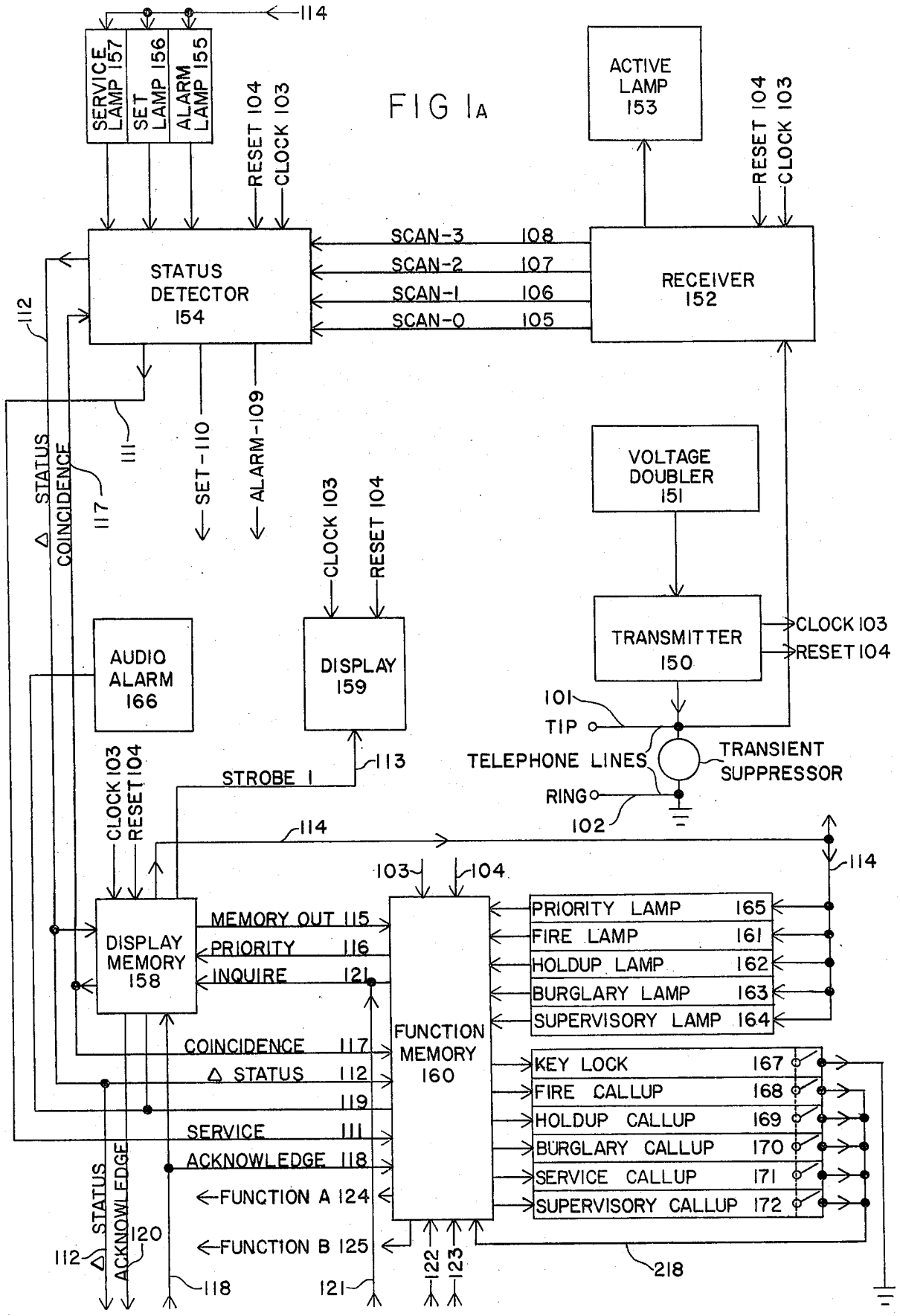
FIG 1A
SERVICE LAMP 157
SET LAMP 156
ALARM LAMP 155
114
RESET 104
CLOCK 103
ACTIVE LAMP 153
STATUS DETECTOR 154
SCAN-3 108
SCAN-2 107
SCAN-1 106
SCAN-0 105
RECEIVER 152
112
111
SET-110
ALARM-109
STATUS
COINCIDENCE
117
VOLTAGE DOUBLER 151
TRANSMITTER 150
CLOCK 103
RESET 104
AUDIO ALARM 166
DISPLAY 159
101
TIP
TELEPHONE LINES
TRANSIENT SUPPRESSOR
RING
102
STROBE 1
113
DISPLAY MEMORY 158
MEMORY OUT 115
PRIORITY 116
INQUIRE 121
FUNCTION MEMORY 160
103
104
PRIORITY LAMP 165
FIRE LAMP 161
HOLDUP LAMP 162
BURGLARY LAMP 163
SUPERVISORY LAMP 164
COINCIDENCE 117
STATUS 112
119
SERVICE 111
ACKNOWLEDGE 118
FUNCTION A 124
FUNCTION B 125
KEY LOCK 167
FIRE CALLUP 168
HOLDUP CALLUP 169
BURGLARY CALLUP 170
SERVICE CALLUP 171
SUPERVISORY CALLUP 172
120
122
123
218

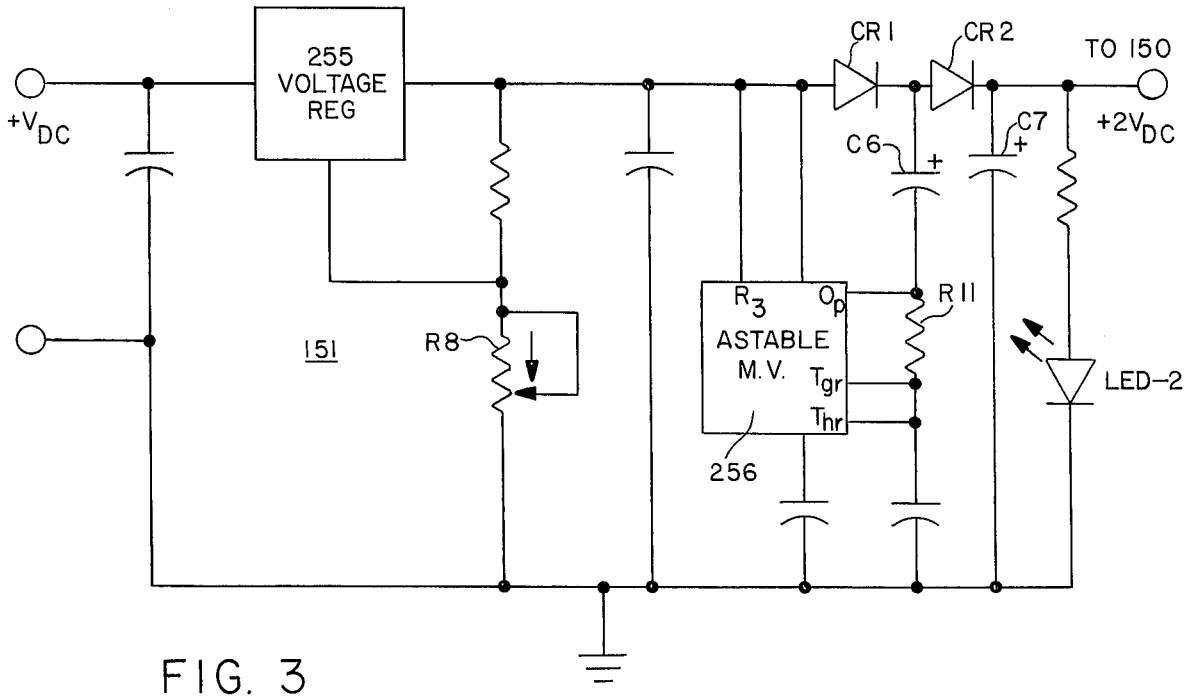
FIG. 3
FIG 4
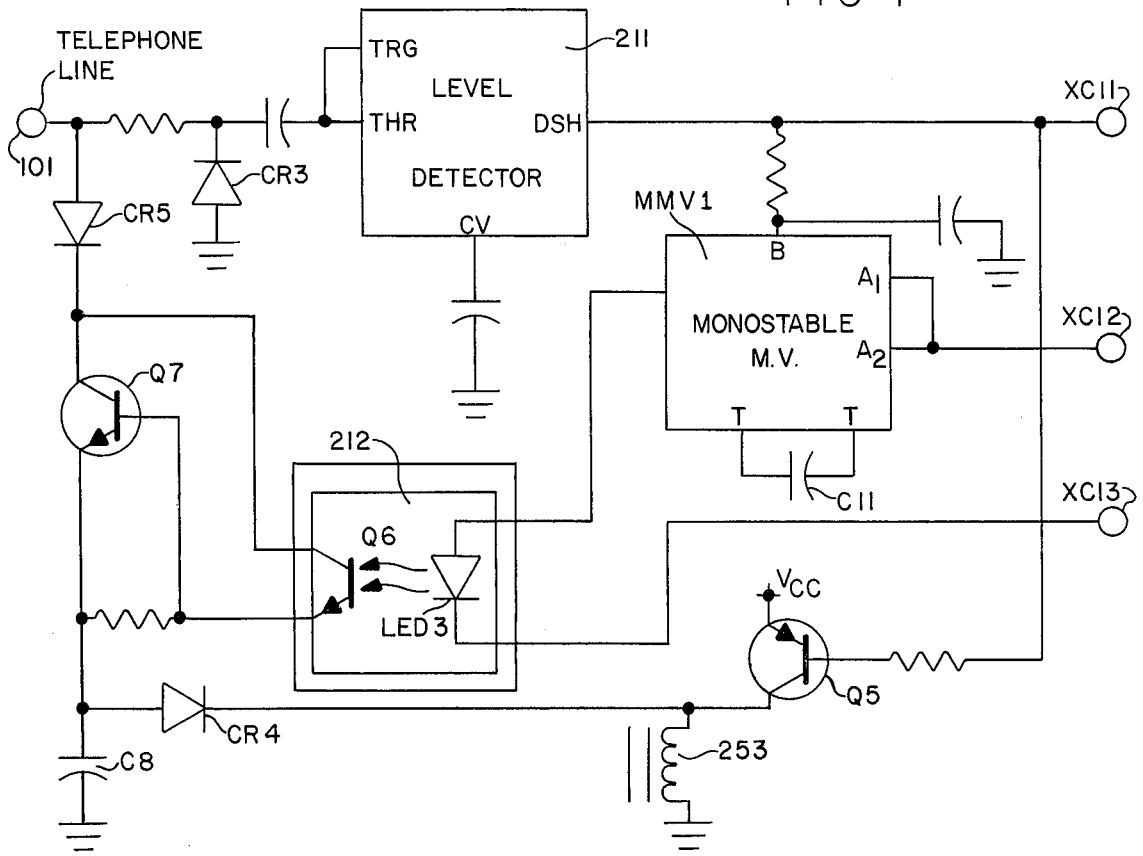

152
RESET 104
105
108
107
106
RANDOM ACCESS MEMORY RAM 4
RANDOM ACCESS MEMORY RAM 3
RANDOM ACCESS MEMORY RAM 2
RANDOM ACCESS MEMORY RAM 1
BINARY COUNTER
BC 3
BC 2
TO ACTIVE LAMP (153)
Q 11
Q9
LEVEL DETECTOR
215
214
C 21
C18
C17
C16
C 15
R16
MONO-STABLE MV MMV 2
FLIP FLOP FF6
MONO-STABLE MV MMV 3
DETECTOR WAVE SHAPER
213
R15
C14
CR 12
CR 11
CLOCK 103
TELEPHONE LINE
101

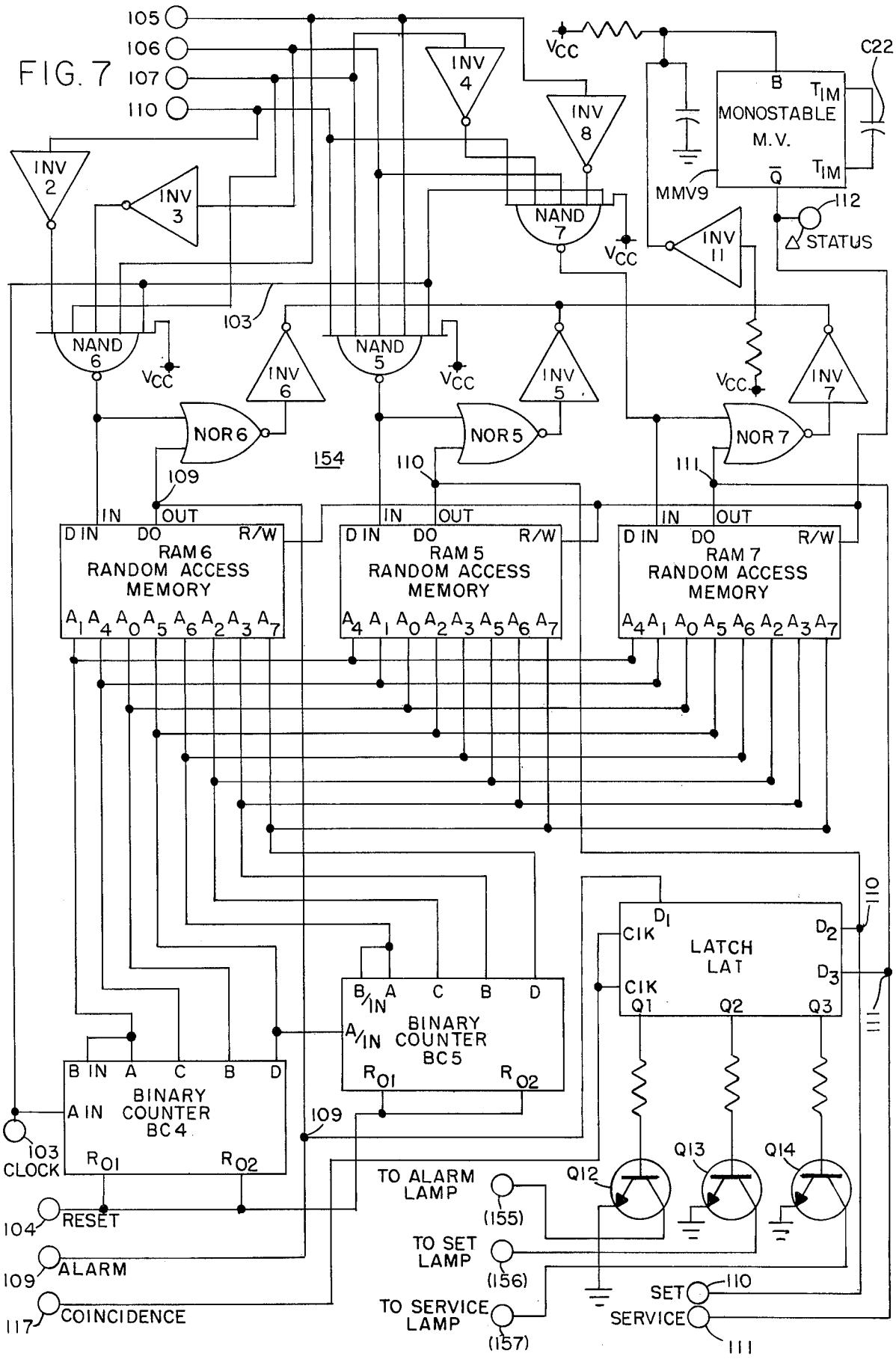
FIG. 7
105
106
107
110
INV 2
INV 3
INV 4
INV 8
NAND 7
NAND 6
NAND 5
INV 6
INV 5
INV 7
INV 11
NOR 6
NOR 5
NOR 7
VCC
C22
B
TIM
MONOSTABLE
M.V.
Q̄
TIM
MMV9
112
STATUS
103
154
109
110
111
IN
OUT
D IN
DO
R/W
RAM 6
RANDOM ACCESS
MEMORY
RAM 5
RANDOM ACCESS
MEMORY
RAM 7
RANDOM ACCESS
MEMORY
A1 A4 A0 A5 A6 A2 A3 A7
A4 A1 A0 A2 A3 A5 A6 A7
A4 A1 A0 A5 A6 A2 A3 A7
D1
CIK
LATCH
LAT
D2
D3
CIK
Q1
Q2
Q3
B/IN
A
C
B
D
A/IN
BINARY
COUNTER
BC5
R01
R02
B IN
A
C
B
D
A IN
BINARY
COUNTER
BC4
R01
R02
103
CLOCK
104
RESET
109
ALARM
117
COINCIDENCE
TO ALARM
LAMP
(155)
TO SET
LAMP
(156)
TO SERVICE
LAMP
(157)
Q12
Q13
Q14
SET
SERVICE C24
STATUS
112
INQUIRE
121
TP
TP
MONO STABLE M V
MMV4
MONO STABLE M V
MMV5
RAM 8
RANDOM ACCESS MEMORY
MEMORY OUT
NAND 8
115
158
ACK 120
CLK 103
CLR
FLIP FLOP FF7
PRS
STROBE 1
113
CR14
+VDC
Q15
Q16
114
C24
MONO STABLE M V
MMV6
RAM 11
RANDOM ACCESS MEMORY
R18
CR13
C25
Q17
119
NAND 11
OUT
CLOCK 103
CR15
NAND 12
FLIP FLOP FF8
ACKNOWLEDGE 118
BINARY COUNTER
BC 6
BC 7
RESET 104
NAND 16
NAND 15
NAND 14
NAND 13
FLIP FLOP FF11
116
PRIORITY
COINCIDENCE 117

MULTIPLEX INTERROGATION SYSTEM USING PULSES

BACKGROUND AND SUMMARY OF THE INVENTION

This invention relates to electrical communication multiplex systems, and more particularly to such systems of the interrogator-responder type which automatically respond to preselected conditions at protection zones. Such systems may be used to monitor fire, burglar, holdup and supervisory conditions, for example. The system may find other applications, including those in which any particular condition may be defined by a particular status of an electrical circuit. Examples of such other uses include the detection of high water or the change of conditions of a patient in a hospital when such conditions may be represented by temperature, respiration rate, or other measurable factors. Thus, the uses for the present invention are virtually limitless, and it is expected that the applications of the present system will be those in which a relatively rapid indication of an alarm condition or change of status is desired.

It is the usual practice in multiplex systems for monitoring a plurality of protection zones to provide one central station from which a source of interrogation signals originates to be supplied to a plurality of transponders or responders which reply according to the condition of the particular protection zones with which each transponder is associated. The common supply of interrogation signals requires that the transponders distinguish among the interrogation signals according to each interrogation signal addressed to a particular zone, so that only a response from an addressed protection zone will be supplied to the central station. Consequently, the other transponders associated with the non-addressed protection zones must reject all interrogation signals other than those interrogation signals intended to evoke a response. In this manner, the central station may interrogate and receive information about the status of each protection zone from their associated transponders as each is addressed and replies in turn. Although such known multiplex systems may appear unduly complex, it is advantageous in that only one central station providing the source of interrogation signals is required, since the single central station will provide a central and rapid indication of an alarm status or change of status from which authorized personnel such as fire persons and police persons may be dispatched in response to an alarm condition.

Known prior art multiplexing systems used to accomplish the foregoing general practice of monitoring a plurality of protection zones are relatively complex and expensive. Usual prior art systems involve the use of pulse width modulated or pulse code modulated signals from the central station to address or designate certain and individual transponders associated with particular protection zones for activation and response. Since the transponders are addressed by pulse width or pulse code interrogation signals, they must respond with similar pulse width modulated reply signals. Consequently, both the central station and each remote transponder must include the relatively complex circuitry necessary to detect, decode, transmit and receive information by the modulated signals. Such complex systems, of course, necessarily involve significant expense.

Known pulse width and pulse code modulation multiplex alarm systems generally require very high grade electrical conductors connecting the central station with each remote transponder, due to the necessity of maintaining the high frequency modulated interrogation and reply signals without significant degradation. These communication paths are generally special telephone lines and the lease cost or tariff rate of high grade telephone lines suitable for maintaining high frequency signals at high information transmission rates is relatively expensive. Alternatively, if the electrical conductors are to be avoided, radio communication paths may be established, but the radio transmitters and receivers involve significant expenses too. Thus, because of the relatively complex nature of signal employed, the prior art systems require relatively costly communication paths between the central station and the remote transponders.

Pulse code or pulse width modulation signals are generally employed by prior art multiplex systems to avoid false signals which might occur as a result of response by transponders associated with non-addressed protection zones or by spurious electrical signals such as those that result from electrical transients caused by lightning, switching or interruption of service. Owing to the complex nature of the modulated signals used in the prior art systems, spurious signals generally have little effect, but this avoidance is possible only through the use of the complex and expensive circuitry and system design of such modulated systems.

It is the general object of this invention to provide a multiplex interrogation system using pulses for monitoring protection zones which avoid the foregoing deficiencies of the prior art and which provides superior performance relative to known multiplex systems at significantly lower cost than such known systems.

It is an object of this invention to provide a multiplex interrogation system which determines the alarm status of a protection zone from a response pattern comprised of replies over a predetermined number of prior sequential interrogations of that protection zone.

It is another object of this invention to provide a multiplex interrogation system for monitoring protection zones which employs relatively simple circuit elements in the central station and in the transponders.

It is a further object of this invention to provide a multiplex interrogation system operating with relatively non-complex signals for interrogation and reply.

It is another object of this invention to provide a multiplex interrogation system which is compatible with and functions very effectively with low cost communication paths such as low grade telephone lines.

It is another object of this invention to provide a multiplex interrogation system which significantly reduces the amount of communication necessary between the transponders and the central station to enhance the performance of the system and reduce the cost.

It is another object of this invention to provide a high amount of information communication from use of an unmodulated pulse signal.

It is still a further object of this invention to provide information communication under conditions highly immune to spurious signals and other false signals while still providing a rapid response to a genuine alarm condition.

It is still a further object of this invention to provide a multiplex interrogation system which will continue to provide information even if some of the transponders become disassociated with or disconnected from the electrical paths connecting them to the central station.

It is a further object of this invention to provide ready recognition of alarm conditions at the central station, to provide a record of the alarm conditions, and to provide a classification of priority of the relative importance of various alarm conditions if multiple alarms arrive at the central station in close time proximity.

To achieve these and other objects as well as further advantages, one embodiment of the present multiplex interrogation system may monitor a large number of protection zones over a single pair of inexpensive and low-tariff DC grade telephone wires. The protection zones may be utilized for many functions including fire alarm monitoring, burglar alarm monitoring, holdup alarm monitoring, or supervisory condition monitoring. Each protection zone may be assigned any type of function. The system may utilize DC pulses for interrogation and reply of information transmittal. The central station addresses each protection zone in sequence by sending out a positive interrogation pulse on the telephone line. The number of interrogation pulses sent in each scan of all zones is designated "*n*". Each transponder counts the interrogation pulses supplied by the central station, and responds only to the particular interrogation pulse which corresponds to the count assigned to that particular protection zone monitored by its associated transponder, each protection zone having a different numerical assignment between the numbers 1 and "*n*". The response of the transponder is a reply pulse immediately following the interrogation pulse according to the condition of the protection zone. Addressing an interrogation pulse to the protection zone and the return of the reply pulse from the transponder associated with the protection zone addressed after receipt of the interrogation pulse consecutively occurs until each protection zone has been interrogated. Interrogation of every protection zone comprises one scan of all of the protection zones of the entire system. At the termination of each scan, the system resets and another scan is made. As the system is continually scanned, a response pattern of the reply pulses over a predetermined number of scans for each protection zone, is developed and the response pattern determines the condition or status of each zone. In a preferred embodiment, four scans are required to determine the status of a protection zone. The response pattern of each protection zone over a predetermined number of scans makes available a number of status conditions, for example, a set condition, an alarm condition, or an out-of-service condition. The response pattern also essentially eliminates any effect that spurious signals on the telephone line might cause.

The response pattern is updated on each new scan, and in this manner changes of status of the protection zones are rapidly available. When a change of status has occurred, information stored at the central station is supplied according to the protection zone which has undergone a change in status. This information may include the protection zone number, the function of that zone, and the status to which the protection zone has changed. This information is available until an operator overseeing the system acknowledges the change of status and takes action accordingly. Information stored at the central station and the response pattern reduces the communication between the central station and the transponders to a minimum. The information also is used to determine the relative priority between a number of rapidly occurring alarm conditions. Some alarm conditions such as fire and holdup are designated as priority alarms, and in the event that a priority alarm status is determined at approximately the same time as a non-priority alarm status is determined, the central station has a provision for distinguishing between priority and non-priority alarms so that the priority alarm information is provided in precedence over the non-priority information.

The present interrogation multiplex system also has provision by which an operator at the central station can inquire about the alarm status of any protection zone and may receive information about that zone. Information of protection zones available for use or currently out of use due to broken wires or other similar disconnection in the communication path is also available. This system also includes means to synchronize the addressed interrogation of the protection zones and the reply of the transponder associated with the addressed protection zone.

A fuller understanding of the invention as to its organization, method of operation and practice, and further objects and advantages may be obtained by reference to the following brief description of the drawings and detailed description of the invention.

BRIEF DESCRIPTION OF THE DRAWINGS

FIG. 3 is a schematic diagram of a preferred embodiment of a voltage doubler forming a part of the present invention;

FIG. 4 is a schematic drawing of a preferred embodiment of a transponder receiver forming a part of the present invention;

FIG. 7 is a schematic drawing of a preferred embodiment of a status detector forming a part of the present invention;

DETAILED DESCRIPTION OF THE INVENTION

Figure 1B:
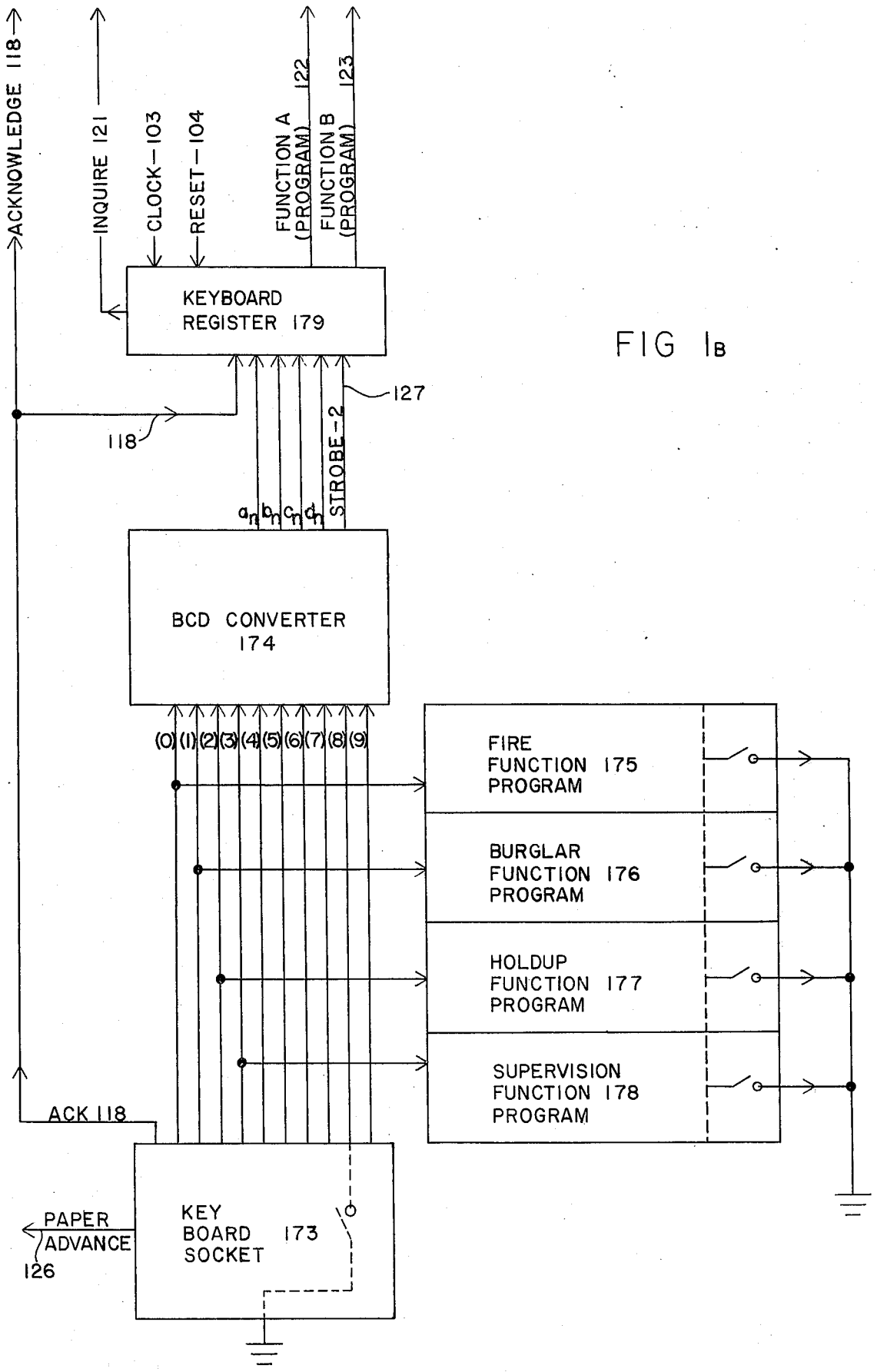
FIGS. 1*a, b, c* are a block diagram of a preferred embodiment of the present invention.

A general description of the central station interrogation apparatus multiplex system is available in conjunction with FIG. 1. Telephone lines to which the system is connected are referenced at 101 and 102. The transponders (not shown) for monitoring the condition of each protection zone are connected in parallel along the telephone lines. The parallel connection avoids disconnection of communication with all the protection zones if a discontinuity in the electrical signal path occurs to less than all the transponders. The telephone lines may go from the central station out to the telephone system and through various trunks to the particular locations of the transponders at the protection zones such as at homes and businesses, for example. Conceivably, a large number of protection zones could be monitored in this manner; however, the various fire codes and regulations require this number be limited. For example, Underwriters Laboratory Standards, ANSI SE2.2 - 1972 requires the protection zones monitored by one system be limited to 199, and that these protection zones be monitored by no more than 100 conections to the telephone lines. Thus, more than one protection zone may be monitored from one connection to the telephone lines. A transient suppressor may be connected across the telephone lines to help reduce the effect of spurious electrical signals.

A transmitter 150 contains a system clock for supplying interrogations pulses to the telephone line 101 and for supplying internal clock pulses on conductor 103 to the various elements of the central station system in synchronism with the interrogation pulses. A voltage doubler 151 is provided to cause these interrogation pulses of the transmitter 150 to have a voltage level sufficient for transmission throughout even a relatively extensive telephone line system. The interrogation pulses as used with telephone lines are preferably effectively positive. The transmitter delivers a sufficient number of consecutive pulses to the telephone line so that each protection zone may be addressed and interrogated in sequence. The addressing of each protection zone connected to the telephone line forms one scan of the protection zones, and at the end of each scan the trasmitter provides an end-of-scan rest period or signal to reset all the transponders associated with the protection zones and thereby ready them to begin counting interrogation pulses at the beginning of the next scan so that they may respond according to a particular interrogation pulse addressed to a particular protection zone. The end-of-scan signal also appears as a reset signal on conductor 104 to reset each of the elements of the central station so that these elements may likewise be synchronized for the next scan. In addition, transmitter 150 may also provide at least one intermediate rest period or scan signal between the initiation and the termination of each scan of the protection zones on the telephone lines. The intermediate scan rest period is recognized by the transponders to cause the counters of the transponders to synchronize to a predetermined count according to the point in the scan when the intermediate scan rest period is provided.

Each transponder at the remote locations counts the interrogation pulses supplied by the transmitter to the telephone lines. When the count of the supplied interrogation pulses achieves that number assigned a particular protection zone, the transponder associated with the particular protection zone so addressed is rendered active to supply a reply pulse on the telephone lines according to the condition of that protection zone. The reply pulse is preferably an effectively negative pulse and is received at a receiver 152, in the present embodiment using telephone lines.

The receiver 152 detects the reply pulses from the transponders and sets into memory a signal indicative of a reply of each protection zone addressed according to the number assigned the protection zone as determined by the internal clock pulse on conductor 103. The receiver further remembers the replies of each particular protection zone during a predetermined number of immediately preceding scans. A preferred embodiment of the present system provides a pattern of responses over the preceding four scans, thus requiring the status to be determined only after four interrogations. In this manner, it is highly improbable that spurious signals would occur at exactly the same time in each scan to cause a false alarm. If spurious pulses do occur and effect a reply from a particular protection zone, this spurious effect will be essentially ignored because of the number of scans required before the response pattern signifies a change in status.

In general, the probability of a spurious signal effecting the response of any given protection in four sequential interrogations so as to cause a false response pattern has been found to approximate one chance in one million million (1 in $10^{12}$). Thus, false alarms are virtually eliminated and the response pattern is a highly reliable indication of the true status of the particular protection zone from which it originated.

The response pattern is supplied in synchronism with the protection zone addressed, and is continually updated with each new scan so that the history of replies from the four immediately preceding scans is available on conductors 105 through 180, respectively, designated Scan, Scan -1, Scan -2, and Scan -3. Scan is the instant interrogation and Scan -3 is the oldest or fourth scan. Thus, the response pattern on conductors 105 through 108 is in synchronism with the particular protection zone addressed and is changed to reflect the response pattern of each addressed protection zone in synchronism with the interrogation of that protection zone during the scan. The receiver 152 supplies power to the active lamp 153 which indicates that reply pulses are being received from the transponders, thereby indicating the system is operating. When no responses are received, the active light is extinguished.

A status detector 154 receives as input on conductors 105 to 108 the response pattern of a particular protection zone in synchronism with the interrogation of that particular protection zone. From the response pattern the status detector determines the alarm status of that particular protection zone and records that status in memory. The status of each particular protection zone recorded in memory is available for lighting lamps indicative of that status such as an alarm lamp 155, a set lamp 156, or a service lamp 157, depending upon the condition or status of the protection zone. The memory also supplies outputs on conductors 109, 110 and 111, respectively, indicative of an alarm, set or service status in synchronism with the addressing of each protection zone. Once the status is determined, a significant factor is a change of status which occurs when the response pattern changes to indicate a changed status. As each response pattern is updated with each new scan, the response pattern indicative of one status is compared to the recorded status in the status detector, and if a change of status is detected, a signal (Δ status) is supplied on conductor 112 and the new status is entered into the memory of the status detector. So long as the status of each particular protection zone remains the same, no change of status signal is applied on conductor 112.

A display memory 158 or information memory means receives change of status signals on conductor 112 in conjunction with the internal clock pulse on conductor 103 corresponding in count to the particular protection zone addressed. An internal memory in the display memory 158 records the change of status signals on conductor 112 at addresses corresponding to the particular protection zone being addressed. If a change of status occurs, the signal on conductor 112 is recorded in memory at an address corresponding to the number assigned to the protection zone having undergone a status change, and this recorded signal indicates that the information relative to the particular protection zone must be provided, which also alerts the operator at the central station of the change in status of that particular protection zone. To provide this information, a strobe -1 signal is applied on conductor 113, power is applied on conductor 114, and a memory out signal is applied on conductor 115. The purpose of the strobe -1 signal on conductor 113 is to provide a visual display of the number of the particular protection zone which has undergone a change of status. The purpose of the power applied on conductor 114 is to light lamps which are indicative of the alarm status of that particular zone and the type or function of protection at that particular protection zone, thus, providing the operator with all the necessary information regarding that particular protection zone. The memory out signal on conductor 115 is to ultimately determine whether changes in status have occurred in protection zones having a higher priority of function or type. If such changes have occurred in higher priority function protection zones a signal is received on conductor 116 by the display memory which causes a display memory to provide the information regarding the higher priority protection zone which has subsequently undergone a change of status.

When a change of status signal has been received by the display memory 158 signals are applied on conductors 113, 114 and 115 in conjunction with the clock pulse on conductor 103 corresponding to the interrogation of the particular protection zone which has undergone a change of status. The strobe -1 signal on conductor 113 causes a number to be displayed by the display 159 which is the number corresponding to the count of the internal clock pulses appearing on conductor 103. The strobe -1 signal latches the internal clock pulse count at the display 159 and provides its visual indication. Simultaneously, a coincidence signal is applied on conductor 117. The coincidence signal is applied to the status detector, and causes a current path to be latched through one of the lamps 155 through 157, according to the status determined by the response pattern. The coincidence signal is also applied to a function memory 160 to complete and latch a current path from conductor 114 through one of a number of lamps 161 through 164 indicating the function or type of protection at the particular protection zone which has undergone a change of status. A current path is also supplied through a priority lamp 165 for activating that lamp when a change of status is in the display memory 158 for a change of status for a protection zone of higher priority importance.

After the information provided has been recognized by the operator at the central station, the information is cancelled or acknowledged by the operator by provision of an acknowledgement signal on conductor 118. The acknowledgement signal removes the information on lamps 155 through 157 and 161 to 165 and cancels the number displayed at the display 159. If the information is not acknowledged in a predetermined time after it is originally provided, an audio alarm 166 is activated by the presence of a signal on conductor 119. The audio alarm 166 is also activated for a short time by an initial change of status determined by the status detector. A signal is provided on conductor 120 whenever the information displayed is acknowledged.

In addition to providing the information during change of status conditions, information may also be provided by request of the operator at the central station. This information may be requested in relation to a particular protection zone or in relation to one function assigned to all of the protection zones of a particular type. With either request, an inquire pulse is received by the display memory 158 on conductor 121 in coincidence with the internal clock pulses at conductor 103 to call up the particular information provided as a result of the signals from the display memory relative to the addressed protection zone or zones. When an inquire pulse is received on conductor 121 the information is provided by the signals from the display memory as has been similarly described for change of status signals.

The function memory 160 allows the programming of the function to each particular protection zone according to the number of that zone, and this information is retained in memory. The function memory 160 determines which of the functions programmed to each of the protection zones is of a priority nature and when a signal is received on conductor 115 indicating a change of status of a particular zone, if that change in status coincides with a priority class of functions, the function memory supplies a signal on conductor 116 indicating that a priority change in status has occurred. Signals for programming the function memory according to the function assigned to each particular protection zone are received on conductors 122 and 123. This function information is stored into memories of the function memory 160 at addresses corresponding to the protection zone number, and this function information for each protection zone is supplied on conductors 124 and 125 in synchronism with the count of pulses from the internal clock. Receipt of a coincidence signal causes a current path through the lamps 161 through 165. To provide information relative to the function assigned to each of a number of protection zones, switches 168 through 172 may be activated according to the type or function of information to be provided. Switches 168 through 170 and 172 relate to the type or function assigned to each protection zone. A service call up switch 171 is provided to provide information of those numbers which are available for assignment to new protection zones when the system is expanded to encompass its full capacity for protection or to provide information of those protection zones which have become disconnected from the telephone lines. The signal received on conductor 111 is used in conjunction with providing this information.

By depression of one of the switches 168 through 172, the information relative to the protection zones according to their function is provided by function memory 160. The clock pulses addressing memory locations corresponding to the number assigned the protection zones being interrogated causes inquire signals on conductor 121 to be produced when a protection zone addressed has the function of the call up switch that is depressed. The inquire signals on conductor 121 during call up occur in conjunction with the particular clock pulse on conductor 103 addressing the desired protection zone via conductor 101.

Referring now to elements in the system having to do primarily with operator communication with the system, there is provided a keyboard socket 173. This socket allows connection to a keyboard having switches which hold to reference potential one conductor of the keyboard socket according to the key depressed. The signals from the keyboard socket represent the digits 0 to 9 and provide the acknowledge signal on conductor 118 and a paper advance signal on conductor 126. Connected in parallel with the signal on the lines representing digits 0 to 3 are switches 175 to 178 to program the type of function to be assigned to the protection zones.

A BCD convertor 174 receives signals from the keyboard indicative of the decimal digits 0 to 9 and provides a binary coded decimal equivalent on conductors $a_n$, $b_n$, $c_n$ and $d_n$. A strobe -2 signal on conductor 126 is supplied each time a decimal input is applied to the BCD convertor 174.

A keyboard register 179 receives the binary coded decimals on the conductors $a_n$ through $d_n$, and also receives the strobe -2 signal on conductor 127 to designate the presence of a BCD digit. The keyboard register stores in memory the BCD equivalent of the three digits designating 100's, 10's, and units of the particular protection zone whose number has been depressed at the keyboard. Once stored, the number of the protection zone is compared to the count of pulses supplied by the internal clock, and when the count of pulses reaches the same number as that of the protection zone in the keyboard register memory, an inquire pulse is generated at conductor 121, which has the effect previously described. To program a function for a protection zone after the particular protection zone addressed at the keyboard has been brought onto the display 159, the key lock switch 167 from the function memory 160 is closed and one of the function switches 175 through 178 is depressed. This signal indicative of the function is then supplied via conductors $a_n$ through $d_n$ to the keyboard register 179 where this function information is then supplied on conductors 122 and 123 to the function memory to be programmed as the function for the particular protection zone and display.

Upon receipt of an acknowledge signal on conductor 118, the memories of the keyboard register 179 indicative of a particular zone number are erased so that an inquire pulse on conductor 121 will no longer be effective.

A printed indication of the information provided is also available with the system. Information for printing is provided when a change of status of a particular protection zone occurs and when acknowledgement of the change of status occurs. A printer memory 180 receives on conductors 112 and 120 signals indicative of changes of status and acknowledgement, respectively. This information is stored in the printer memory and is used to command the printing elements of the present system to provide the information for printing. The signals of a change of status and an acknowledgement are supplied to memories at addresses corresponding to the number of particular protection zone for which the information is to be printed. In this manner, all changes of status and acknowledgements may be retained in the printer memory even though this information may not yet have been printed by the printer mechanism. When a signal indicative of a change of status is entered into memory indicating that the information relative to that particular protection zone is to be printed, a strobe -3 signal on conductor 129 occurs when the printing is to begin. Simultaneously, a print signal is applied on conductor 130. After a predetermined time in which all the information from the printer should have been printed, a print complete signal is returned on conductor 131 which signals the printer memory that it may then select the next information stored to be printed. Upon receipt of the print complete signal on conductor 131, the printer memory 180 may again supply a strobe -3 signal on conductor 129 to initiate further printing. In the same manner as has been previously described for the printing of change of status information by a strobe -3 command, acknowledgement information appearing on conductor 120 to the printer memory 180 is printed by supplying an acknowledge signal on conductor 132. Simultaneously with the application of an acknowledge signal on conductor 132, a print signal on conductor 130 is supplied and when the printing process of the acknowledgement is complete, a print complete signal is returned to the printer memory on conductor 131.

A printer latch 181 seizes information relative to the number, alarm status, and the function a particular protection zone when a strobe -3 command or acknowledgement command is received. This seized information is held by the printer latch until it is printed by the printer. The status information of alarm or set conditions is supplied from the status detector 154 on conductors 109 and 110. The function assigned to a particular zone is received on conductors 124 and 125 from the function memory 160. The number of a particular protection zone is received in correspondence with the input of pulses from the internal clock on conductor 103 and the strobe -3 or acknowledge command is received only when the count of the internal clock pulses matches the protection zone number to be printed. Signals on conductors $a_p$ through $d_p$ indicate in binary coded form the availability for printing of particular characters by the printer. These signals are necessary to correlate the information in the printer latch with the mechanical position of the characters of the printer. When the signals on conductors $a_p$ through $d_p$ correspond to those characters of information stored in the printer latch 181, signals are applied on conductors 133 through 137 indicative respectively of the protective zone digits of 100's, 10's and 1's, of the function and of the status of that zone. The printer latch 181 supplies a "red" print signal on conductor 138 when an alarm status condition is to be printed. All other printing is done in black. The "red" print signal causes characters to be printed in red and causes asterisks to be developed on the printed record. A blank command on conductor 139 is supplied when an acknowledgement occurs and prevents the printing of some information which would ordinarily be printed, thereby indicating acknowledgement.

Printer sync 182 functions to provide signals in synchronism with the mechanical character position of the printer according to signals derived from the printer on conductors 140 and 141. The signals on conductors 140 and 141 from the printer represent the position of the characters of the printing apparatus at the printer. In a preferred embodiment the printer has a drum having characters in a number of columns in which each row of the columns has the same character. The drum rotates beneath the paper and as it is desired to print a character on the paper, a hammer forces a ribbon down against the paper which is forced against the character on the rotating drum. In this manner the character is printed. The signal received on conductor 140 indicates the occurrence of one revolution of the printer drum while the signals on conductor 141 provide an indication of the number corresponding to the characters in each row during the revolution. The signals received on the conductors 140 and 141 are used to correspond to various characters on the rotating printer drum, and signals on conductors $a_p$ and $d_p$ in binary coded form represent those characters. Thus, conductors $a_p$ and $d_p$ carry signals representative of particular characters which are passing into a zone of availability for printing by the printer if desired. The various elements of the system using these signals are $a_p$ through $d_p$ as their inputs coordinate the deliverance of an electrical signal to the printer at the proper time so as to cause the printing of the desired character. The revolution sync signal on conductor 140 is also used by the printer sync 182 to control the ribbon advance and the paper advance signals applied on conductors 142 and 143. The ribbon and paper advance signals are applied according to the operation of the printer to achieve proper operation during different revolutions of the printer drum.

The printer sync 182 also supplies a printed indication of the machine or system number of the particular multiplex interrogation system. This is useful in distinguishing the particular printed copy produced by a particular multiplex interrogation system and is necessary when more than one complete system is in operation in a single location. This machine or system number is predetermined internally from the count appearing on conductors $a_p$ through $d_p$. A print enable signal supplied on conductor 300 is applied to the printer so as to enable the printer hammers only when each row of characters on the drum has rotated in position of availability to properly print a character. The print enable signal is not present when the drum is in a position between characters. The print signal received on conductor 130 from the printer memory indicates that information has been selected for printing. A print complete signal is returned to the printer memory after printing is complete so that other information may be selected for printing. The print complete signal is not delivered until a number of revolutions after the printing starts, the number being that required by the printer to achieve all printing in the proper color and proper paper advancement.

In addition to the information provided relative to the protection zones, it is necessary to provide information of the time in which changes of status, inquire and acknowledge signals occur. This information is provided by time clock 183 and a date clock 184. An input to the time clock 183 arrives on conductor 185 and consists of a 60 Hertz signal supplied by a conventional power source, for example 186. The time clock outputs are synchronized with the character position represented by the signals on conductors $a_p$ and $d_p$. These outputs are supplied on conductors 187 through 189, and internally generated signal on conductor 190 provides a colon separating the minutes and hours. A carry signal on conductor 191 is supplied to the date clock 184, and the 60 Hertz signal is coupled to the date clock 184 by conductor 192. The time clock supplies one carry signal every 24 hours which is received by the date clock to increment its count of days of the year. Outputs on conductors 193 through 195 are supplied in conjunction with the character position signals on conductors $a_p$ through $d_p$ to print the day of the year.

The signals on conductors 133 to 137 of printer latch 181, 142 to 145 of printer sync 182, 186 to 190 of time clock 183, and 195 to 197 of date clock 184, are applied to a printer driver 198. The printer driver is an amplifier which receives the input signals and delivers conditioned output signals accordingly to a printer connector 199 for use by the printer to cause the printer to operate properly.

A preferred embodiment of the present invention has just been described in conjunction with the block diagram FIG. 1. A more complete description of this preferred embodiment follows in relation to the details of description of each of the elements of the present invention. Throughout the remainder of the detailed description, individual elements will be referenced by the prefixes as follows. Resistors will be designated by R, capacitors by C, transistors by Q, diodes by CR, light emitting diodes by LED, NAND gates by NAND, NOR gates by NOR, flip flops by FF, binary counters by BC, decode counters by DC, binary coded decimal to one of ten decoders by B/10, modules by M, monostable multivibrators by MMV, retriggerable monostable multivibrators by RMMV, inverters by INV, random access memories by RAM, latches by LH, exlcusive NOR gates by EX and switches by SW. Other elements will be described and referenced by reference numerals. When it is indicated that an input or output or level is high or low, this is intended to reference a quantity of voltage sufficient to form a high or low logic level compatible with the logic elements employed. The modules are generally internal connections which may be made selectively usable elements so as to result in a direct electrical connection between an input and an output. As used generally herein, the term transponder refers to those elements which receive the interrogation signals and transmit reply signals in response to proper interrogation. As used generally, the term transducer refers to apparatus associated with the protection zone loop circuitry that is activated according to the condition or status of that protection zone to supply signals related to that status. The interrogation and reply pulses although described as varying positive and negative from a zero reference potential may, in a manner well known in the art, vary in any manner or be distinguishable from each other in any manner from any other selected reference. Power may be supplied to the components of each preferred embodiment of each element of the system from a storage battery or from a power supply from conventional sources. Direct current supplied to the system has a voltage referenced $V_{DC}$, and this voltage may be reduced and regulated in the conventional manner to a level $V_{CC}$ to be compatible with the various components and logic circuits used throughout.

Figure 2:
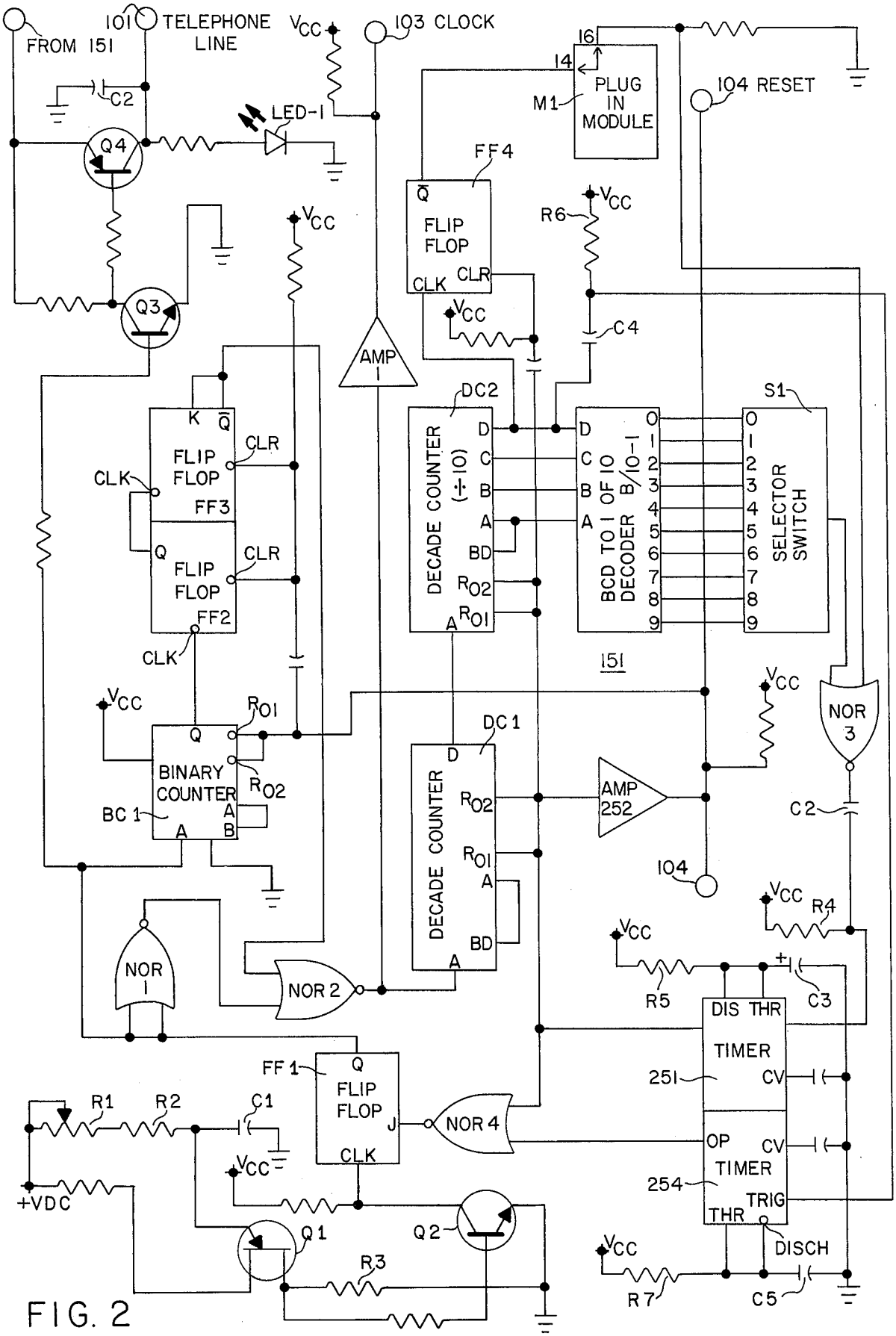
FIG. 2 is a schematic drawing of a preferred embodiment of the transmitter forming a portion of the present invention.

Referring now to FIG. 2 in which one detailed embodiment of the transmitter 150 is illustrated, there is shown a unijunction Q 1 which forms part of a relaxation oscillator. R 1 and R 2 and C 1 form the RC input to Q 1 and the output of Q 1 is applied on R 3. R 1 sets the frequency of oscillation and therefore the rate of application of interrogation pulses will be presently understood. The output from Q 1 is applied to Q 2 where it is amplified and inverted and applied to the clock input FF 1. FF 1 provides a square wave output at one-half the frequency of the relaxation oscillator. The output of FF 1 is applied to Q 3 and Q 4 which switches a positive voltage from the voltage doubler to the telephone line 101 during the positive square wave output of FF 1. In this manner, interrogation pulses are applied to the telephone line 101. LED 1 provides a visual signal with each applied interrogation pulse to indicate the operation of the system. C 2 shapes the interrogation pulses.

The output from FF 1 is also applied to the input of BC 1 connected to divide the count by 16 as its output FF 2 receives input from BC 1 and divides by two and its output is applied to FF 3 causing an output of FF 3 to be high for the duration of the first thirty-two pulses supplied by FF 1 and low for the remainder of the pulses thereafter comprising the scan. The low output of FF 3 is applied as one input to NOR 2 thus providing a high output from NOR 2 due to the low output of NOR 1, NOR 1 being connected invert the output pulses of FF 1. The output of NOR 2 thus begins after thirty-two initial interrogation pulses applied to telephone line 101, and the output after count 32 is amplified by amplifier 250 and is supplied as the internal clock pulses on conductor 103. In the manner just described the internal clock pulses are disabled for a predetermined number of initial interrogation pulses, for example 32, for purposes outside the scope of the invention. The internal clock pulses appearing on conductor 103 are thus in synchronism with the interrogation pulses supplied to the telephone lines and thus form a means for clocking the various elements of the central station in synchronism with the delivered interrogation pulses to the telephone line 101.

Simultaneously with the beginning of the internal clock pulses, pulses from NOR 2 are applied to the input of DC 1. The divide by ten output of DC 1 is applied to the input of DC 2, and the divide by ten output of DC 2 is applied to the input of FF 4. In this manner, DC 1 counts units of internal clock pulses, DC 2 counts 10's of internal clock pulses, and FF 4 counts up to 200 internal clock pulses. The preferred embodiment of the invention has been selectively designed not to interrogate more than 199 protection zones so a count to 200 is adequate. Higher counts could be provided if desired. Outputs from DC 2 indicative of the number of 10's of internal clock pulses are applied to the inputs of B/10-1. The outputs of B/10-1 are in the form of decimal signals indicative of the number of 10's of internal clock pulses and are supplied to selector switch SW 1. The 100's output of FF 4 is applied to M 1, and if the desired length of scan extends beyond 100 protection zones, and internal connection is provided by the plug-in module M 1 between the input and the output. The selector switch SW 1 couples a low signal indicative of the number of 10's of internal clock pulses to NOR 3. The other input to NOR 3 comes from M 1, if used. When the internal clock pulse count matches that count set by SW 1 M 1 signifying the end of the scan of interrogation pulses to the protection zones, both inputs to NOR 3 go low and high output pulse is provided. A differentiator formed by C 2 and R 4 couples a signal to timer 251. The output of timer 251 immediately goes high on receipt of the signal thereby providing one high input to NOR 4 and resetting DC 1 and DC 2 and FF 4. Simultaneously, a signal is coupled through NOR 4 to FF 1 which prevents it from providing further pulses at its output. The output pulse of timer 251 is amplified by amplifier 252 and its output provides an internal reset pulse on conductor 104 for all elements of the central station of the present invention. The time period of the output from timer 251 is determined by R 5 and C 3 and during this time period, the high output of timer 251 to NOR 4 halts further internal clock pulses or external interrogation pulses. At the termination of the high output from timer 251 the system is ready to resume operation providing multiple scans of interrogation pulses to the transponders associated with the protection zones. The terminal rest period of the end of each scan is recognized by the transponders associated with the protection zones and the terminal rest period causes the transponders to reset their counters to zero and to begin counting with the application of interrogation pulses in the next subsequent scan as will be described more fully.

The transponders associated with the protection zones are likewise provided with means to synchronize their count at at least one intermediate point in the scan. In the particular embodiment shown, this internal synchronization period is applied at count 100. The pulse from DC 2 indicative of a 100 count is coupled through differentiator C 4 and R 6 to timer 254. The output of timer 254 immediately goes high and is coupled through NOR 4 to prevent FF 1 from delivering further interrogation pulses to the telephone line or internal clock pulses to conductor 103. The time during which the output from timer 254 is present is determined by R 7 and C 5, and is a time period which is selected to be less than that of the terminal rest period supplied by the timer 251. Note that the output from timer 254 does not effect the internal count of DC 1, DC 2 and FF 4, nor is an internal reset on conductor 104 provided. The transponders associated with the protection zones recognize the intermediate rest period and synchronize their counters so as to be react to begin counting at pulse 101 when the output of timer 254 is no longer present, as will also be described more fully.

From the foregoing, it can be seen that the present system provides the very desirable advantage of synchronizing the external transponders at the end of the scan and at one intermediate point if desired. In this manner the effect of any spurious signals that might inadvertently adversely effect the count of each transponder is minimized since the counter of the transponders are reset at least once during each scan. As will be seen subsequently, each transponder must respond over a predetermined number of scans before the state of the protection zone associated with it is recognized as changed. The predetermined number of scans forming a response pattern in addition to the synchronization of count at the end of the scan and possibly at one intermediate point, insure a high degree of integrity during the interrogation process that the actual conditions at a protection zone are communicated. Furthermore, as has been seen from the detailed description of the transmitter 150, and as will be seen from other elements of the present invention, the interrogation pulses applied to the telephone lines are direct voltage type of pulses which may be generated relatively easily by relatively inexpensive circuit elements. In this manner, no complex and expensive dircuitry is required to use the information conveyed during the interrogation process.

The voltage doubler 151 supplies increasd DC voltage to the transistors of the transmitter 150 which couple the positive Dc pulses to the telephone line 101. The voltage doubler provides an output which is sufficiently high to maintain the interrogation pulses throughout the entire telephone line system connecting all the transponders. The preferred embodiment of the voltage doubler is shown in FIG. 3. Voltage $V_{DC}$ from a supply such as a battery is filtered and supplied to the input of a voltage regulator 255. The output of the voltage regulator is adjustable by R 8 and is filtered and supplied to an astable multivibrator 256. The astable multivibrator operates at several kilohertz, and when its output is low C 6 charges through CR 1. When the output goes high the voltage across C 6 appears in series with the output of the voltage regulator which effectively doubles the voltage. CR 1 is reversed biased and C 7 is charged through CR 2 to the higher voltage. CR 2 is reverse biased when C 6 is charged through CR 1. LED 2 signals the presence of high voltage to the transmitter 150.

Figure 5:
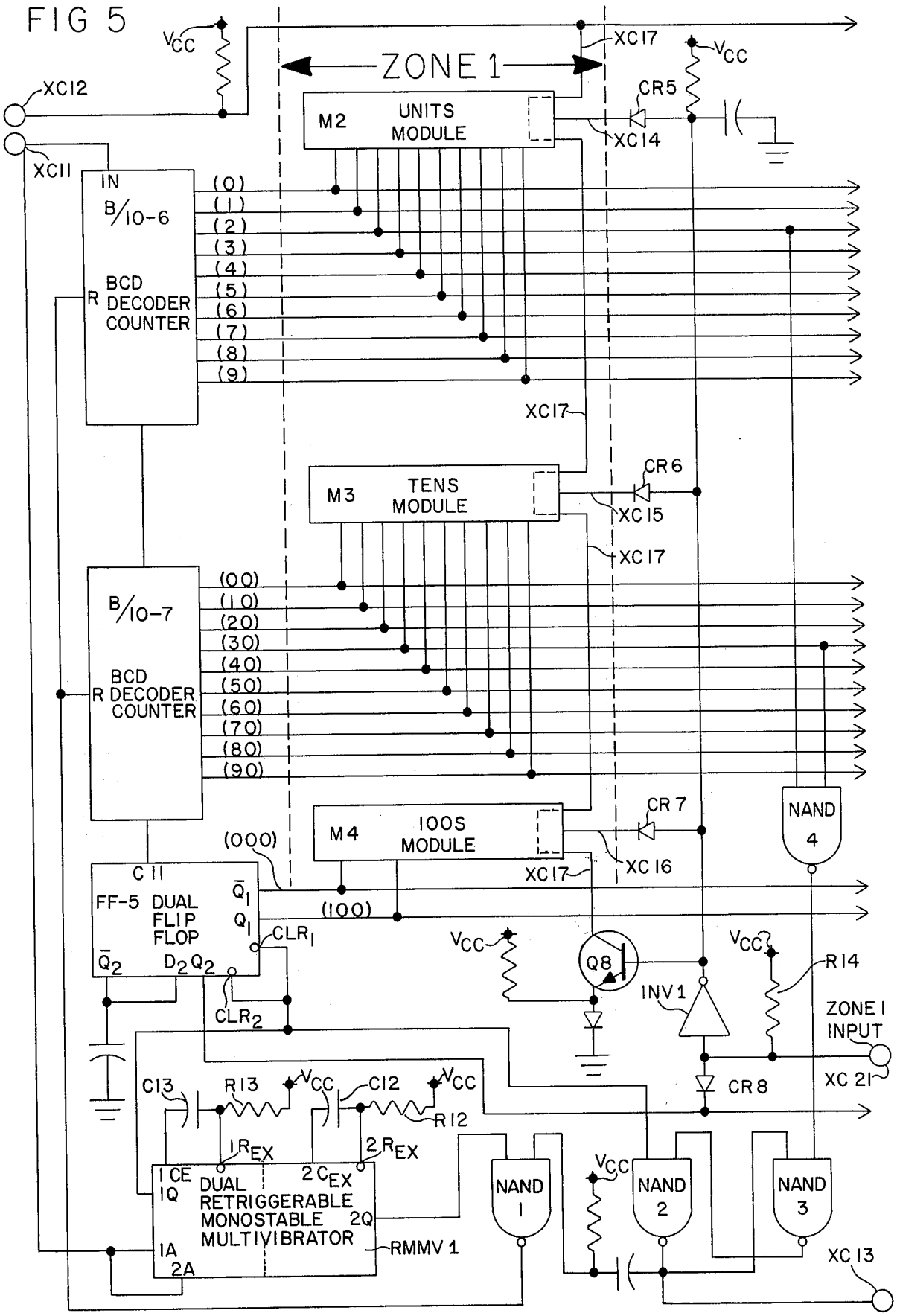
FIG. 5 is a schematic drawing of a preferred embodiment of a transponder zone circuit forming a part of the present invention.

A preferred embodiment of the transponders which may be used in conjunction with the present invention comprises a transponder receiver shown in FIG. 4 and a transponder zone circuit shown in FIG. 5. The protection zone circuitry associated with the transponder zone circuit located in the actual protection zone is known in the art. The protection zone circuitry is described but not shown; however, it may be functionally represented by the opening or the closing of a switch. Examples of such protection zone circuitry would include transducers that include switches which may be closed upon the occurrence of a hold up, smoke detectors which signify through a current path the presence of a fire, or conductors on windows which would normally conduct current until the windows are broken during a burglary. The transponders may be powered from a conventional power source at their location.

Referring now to FIG. 4 there is shown a transponder receiver. The transponder receiver generates a negative DC voltage reply pulse on the telephone line 101 after receipt of a predetermined interrogation pulse and receives, detects and shapes the positive interrogation pulses received on the telephone line 101. The positive interrogation pulses received on the telephone line 101 are applied to the input of a level detector 211. Negative signals on conductor 101 are removed by CR 3. The level detector 211 inverts and squares the received interrogation pulses, and applies them to conductor XC 11. The pulses on conductor XC 11 gate transistor Q 5 on and off in synchronism with the received interrogation pulses such that Q 5 is on when an interrogation pulse is present. When Q 5 is conductive, magnetic flux is built up in inductor 253. When Q 5 is not conducting the current through the inductor, it tends to continue flowing due to the inductive properties and C 8 is charged to a negative voltage by the conduction of CR 4. One input of MMV 1 is connected to the conductor XC 11 enabling it to be triggered only during the period between the received interrogation pulses. MMV 1 is triggered by a signal on conductor XC 12. As will be described in conjunction with the transponder zone circuit of FIG. 5, the trigger signal on XC 12 is a function of the status or condition of the protection zone. The output of MMV 1 is applied to LED 3 in an optical coupler 212. Providing conductor XC 13 is connected to supply a current path by the transponder zone circuit according to its condition, LED 3 of the optical coupler causes photo transistor Q 6 to render Q 7 conductive. In conduction Q 7 couples the telephone line 101 through CR 7 to the negative source of voltage at C 8. MMV 1 provides the output to LED 3 for a time determined by C 11, and consequently C 11 determines the length of time of the negative reply pulse that is supplied to telephone line 101 when Q 7 is conductive. Thus, it can be seen that the transponder receiver of FIG. 4 receives the positive interrogation pulses on the telephone line 101 and delivers negative reply pulses to the telephone line when triggered by the signals from the transponder zone circuitry.

A preferred embodiment of the transponder zone circuit is shown in FIG. 5. The transponder zone circuit inhibits the transponder receiver during the initial application of a predetermined number of interrogation pulses, for example, the first thirty-two. The circuit also counts the interrogation pulses, synchronizes the count at the intermediate and end points of a scan, responds to interrogation pulse count numbers assigned to its associated particular protection zones, and responds according to the condition of the protection zone over a predetermined number of scans. Conditioned interrogation pulses from the transponder receiver are received on conductor XC 11 and are applied to the input of B/10-6, which is cascaded to B/10-7 which in turn is connected to FF 5. B/10-6 and -7 and FF 5 have decimal decoded outputs allowing the system to count at least 199, and these counters keep pace with the received interrogation pulses by incrementing accordingly upon each received interrogation pulse.

The received interrogation pulses on conductor XC 11 are also applied to the input of RMMV 1 which contains two separate sections. One section is set to time out by R 13 and C 13 at approximately 200 milliseconds, and the other section is set to time out by R 12 and C 12 at approximately 100 milliseconds. The intermediate rest period provided by the transmitter is approximately 100 milliseconds long, and when the number of interrogation pulses delivered reaches that count when the internal rest period is provided by the transmitter, no received clock pulses are present at XC 11. During this intermediate rest period, the 100 millisecond section of RMMV 1 times out and an output is applied to NAND 1. The output of NAND 1 goes low and B/10-6 and -7 are reset to zero. The count continues onward after the intermediate rest period and at the end of the scan of all protection zones, the transmitter provides a 200 millisecond rest period. Again, and in a similar manner, the 100 millisecond section of RMMV 1 times out and B/10-6 and -7 are reset. Additionally, the 200 millisecond section of RMMV 1 times out and its output resets FF 5. In the manner just described the present invention provides rest period to synchronize each counter associated with the transponders at the remote locations. In this manner, the effects of spurious electrical signals are significantly reduced in relation to the desired performance of the system. If spurious signals were to alter the count of one or more counters of the transponder zone circuits, the rest periods of each scan resets the counters to predetermined counts. The effect of any false responses provided when the counters are out of count are generally insignificant because, as will be understood more fully subsequently, responses from the protection must occur over a predetermined number of scans, before a change of status is recognized and it is highly improbable that spurious signals would occur at the same point in each scan to provide a false alarm indication. Thus, the synchronism and the response pattern (responses over a predetermined number of scans) insure a very close correlation and integrity between the actual condition of a protection zone and the performance of the system representing that condition.

The output from the 200 millisecond section of RMMV 1 toggles NAND 2, and its output is coupled through NAND 1 to provide another reset signal to B/10-1 and -2 again with the reset to FF 5. NAND 2 and NAND 3 form a flip-flop, and when a predetermined count, for example thirty-two, is registered by B/10-6 and -7 NAND 4 is activated. Prior to the activation of NAND 4, conductor XC 13 has been held high to prevent the coupling of pulses through the LED 3 in the optical coupler 212 of the transmitter receiver of FIG. 4. When NAND 4 is activated, the flip-flop formed by NAND 2 and NAND 3 changes state and XC 13 goes low. This change state signal is coupled through NAND 1 to reset B/10-6 and -7 to zero for monitoring the interrogation pulses received at the beginning of the scan. The counters thus are ready to increment upon each received interrogation pulse to keep track of the count of the interrogation pulses addressed to the protection zones during each scan.

The output of B/10-6 and -7 and FF 5 are applied to M 2, 3 and 4 which monitor respectively the output of the units, 10's and 100's of the count of interrogation pulses. Each module is arranged to internally connect a desired input and its output, the outputs of modules M 2, 3 and 4 being respectively connected to conductors XC 14, 15 and 16. When the number of interrogation pulses matches the count set by M 2, M 3 and M 4, CR 5, CR 6 and CR 7 are no longer conductive and Q 8 is biased into conduction. Conductor XC 17 connected to the collector of Q 8 is biased through M 2, 3 and 4 to provide a current path through each module when in place. Thus, when Q 8 is conductive, XC 12 is pulled low which directs MMV 1 of the transponder receiver of FIG. 4 to send a negative reply pulse on the telephone line 101 by conduction of Q 7.

During normal conditions at a protection zone, the transponder produces a reply pulse on the telephone line 101 in response to every other interrogation pulse addressed to the protection zone from the transmitter. A normal condition will be caused by a high signal XC 21 which results from the transducer associated with the well-known protection zone loop circuitry. Thus, this transducer circuitry must be arranged to hold XC 21 high during a normal condition. During alarm conditions XC 21 will be arranged to be held low by the transducer circuitry. This is accomplished by using the 200 millisecond reset period of the scan from RMMV 1 applied to the second half of FF 5, which causes the second half of FF 5 to be toggled on every other scan. This second half output is applied to CR 8, which in conjunction with R 14 supplies input to INV 1. Thus, if the output of INV 1 is low, as it will be on every other scan during a normal condition at the protection zone when XC 21 is high, the output from M 1, M 2 and M 3 will not bias Q 8, and a normal response pattern of one reply pulse for every other interrogation pulse is supplied by the transponder receiver to the telephone line 101. Should the condition at the protection zone be in an abnormal or alarm state, XC 21 will be held low, causing the output of INV 1 to be high regardless of the output of the second half of FF 5. The high output from INV 1 allows Q 8 to saturate upon the receipt of the interrogation pulse count corresponding to that number coupled by M 2, M 3 and M 4. Thus, in an alarm state Q 8 saturates in response to each predetermined interrogation pulse count and reply pulses are supplied on a one-for-one basis after each interrogation pulse addressed to a particular zone.

Although the operation of the transponder for only one protection zone has been described, any desired number of protection zones may be monitored from a transponder zone circuit in a manner similar to that described for zone 1. In such a circumstance, the circuitry for monitoring the other protection zones is connected essentially in parallel to that of zone 1, with each individual protection zone having its input corresponding to zone 1's input at XC 21. The outputs at B/10-6 and -7 and FF 5 are used and three modules decode the particular different counts assigned to the different zones.

It has been previously described that the function of the transponder in response to particular interrogation pulse count is to respond according to the condition of the protection zone. If the protection zone is in a normal or set condition, a reply pulse is supplied to the telephone line in response to every other interrogation pulse addressed to that particular protection zone. If the protection zone is in an alarm condition, reply pulses are supplied in response to every interrogation pulse addressed to that particular protection zone. It is the function of the receiver of FIG. 6 to detect and shape the reply pulses from the transponders, and to remember the response pattern of particular protection zones over a predetermined number of prior consecutive scans, for example, four prior consecutive scans. The response pattern of each particular protection zone is updated with each new scan, so the response pattern reflects the responses of each particular protection zone during the most recent four scans, since the herein described embodiment of the present invention monitors only four consecutive scans to provide the response pattern.

Figure 6:
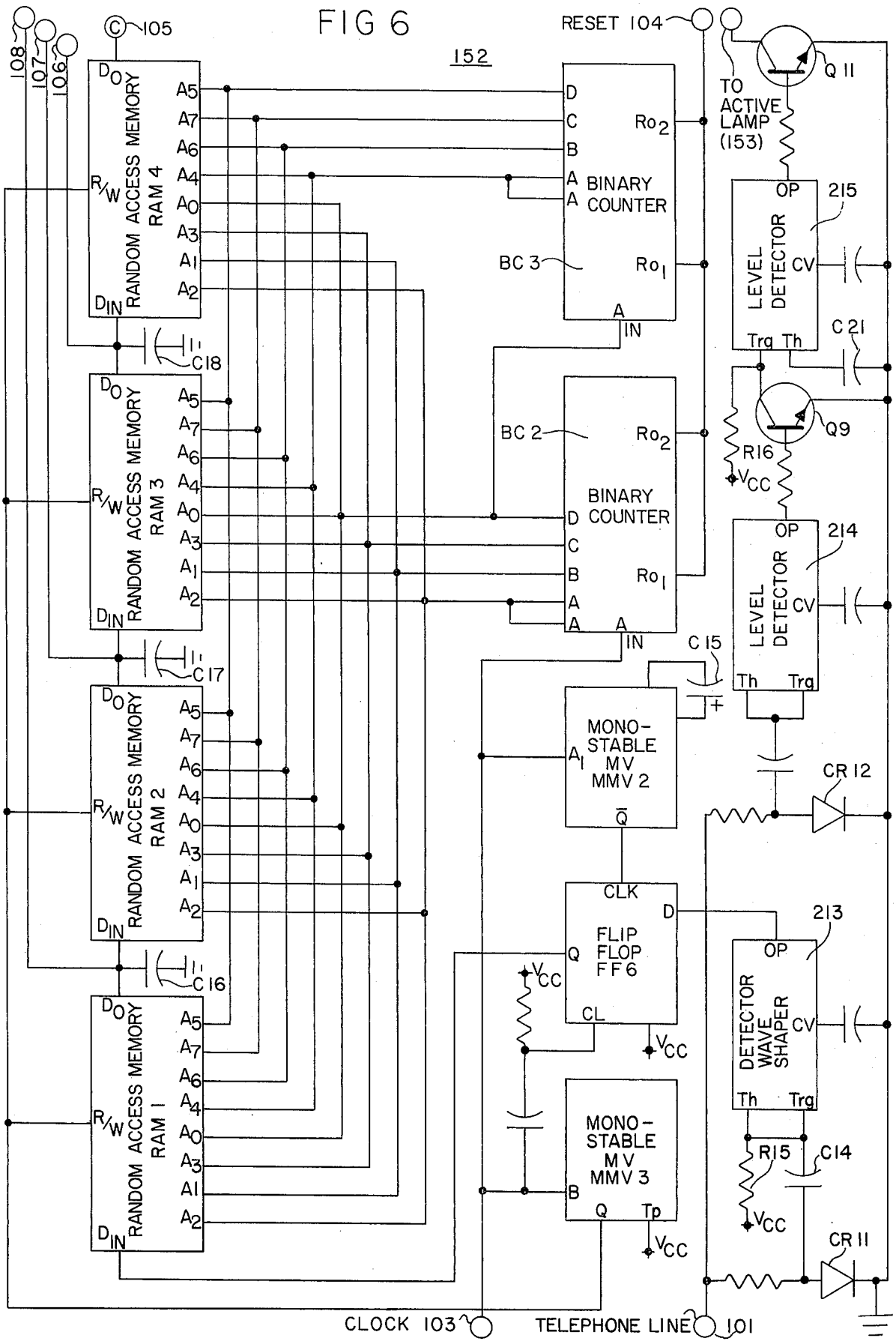
FIG. 6 is a schematic drawing of a preferred embodiment of a receiver forming a part of the present invention.

In FIG. 6, positive interrogation signals and negative reply signals are available on conductor 101. CR 11 and CR 12 eliminate the positive interrogation pulses and allow the negative reply pulses to effect the condition of the receiver. The negative reply pulses are coupled through differentiator C 14 and R 15 to the input of a level detector and wave shaper 213, which inverts, squares and amplifies the input pulse and provides an output pulse. The trigger and threshold levels of the detector 213 are arranged to avoid being triggered by spurious noise signals.

Internal clock pulses are received on conductor 103 and applied to the input of MMV 2. The internal clock pulses are in synchronism with the interrogation pulses, and MMV 2 is triggered by each interrogation pulse. The output from MMV 2 is applied for a time predetermined by C 15 after triggering, and this output is applied to FF 6. The output from MMV 2 will allow FF 6 to sample an input from detector 213 at a time when a reply pulse will have activated detector 213, if the reply pulse is present.

The internal clock pulses at conductor 103 also address cascaded BC 2 and BC 3, and these counters are incremented on the trailing edge of each internal clock pulse. The counters are reset to zero at the end of each scan by a reset pulse on conductor 104. The outputs of BC 2 and BC 3 address in parallel RAM 1, RAM 2, RAM 3 and RAM 4. The output of FF 6 is applied to RAM 1, and the output of each RAM is applied to the input of the next successive RAM. The outputs of RAM's 1 to 4 are brought out on conductors 108 to 105, respectively. The internal clock pulses on conductor 103 are applied to MMV 3, which is triggered on the leading edge of the internal clock pulse. The output from MMV 3 is simultaneously applied to each RAM 1 to 4 to cause the particular data at the input of each RAM to be written upon the receipt of the short duration write pulse from MMV 3. The data present at the input of each RAM is written into memory, inverted and supplied at the output. The output of each RAM is coupled to the input of the next RAM through respective delay elements C 16, C 17 and C 18.

From the foregoing, it can be seen that beginning with the application of internal clock pulses on conductor 102, each RAM is addressed by BC 2 and BC 3 to a memory location corresponding to the count of the interrogation pulses each of which is addressed to a different protection zone. Negative reply pulses are coupled through level detector 213, and an output of FF 6 is available as determined by MMV 2 at a time when a reply pulse could be present on telephone line 101. The reply pulse, if present, is entered into RAM 1 in conjunction with a write signal from MMV 3. During the next scan, the output of RAM 1 is transferred to RAM 2 and new data is entered at RAM 1, again in conjunction with the address location corresponding to the number assigned the particular protection zone whose count has been attained by the internal clock pulses. In similar manner, the outputs of the RAMs provided on conductors 108 to 105 represent the response pattern of a particular protection zone where it is addressed extending over the four prior consecutive scans. The response pattern or scan history on conductors 105 through 108 is changed in accordance with each internal clock pulse to reflect the addressed count of the next protection zone, and in this manner, the receiver holds the response pattern of each protection zone over the preceding four consecutive scans.

An active lamp 153, FIG. 1*a*, is activated when reply pulses are received by a level detector 214, thereby indicating that the system is operating. Level detector 214 operates in a manner similar to detector 213, and its output causes Q 9 to conduct. Q 9 keeps C 21 discharged in the presence of negative reply pulses, and the output of level detector 215 is kept high to cause Q 11 to establish a current flow through the active lamp 153. In the absence of negative reply pulses, Q 8 is not conductive and C 21 charges through R 16 to render Q 11 non-conductive, and the active lamp extinguishes indicating an inoperative condition.

TABLE 1

| Condition | 108 | 107 | 106 | 105 |
|---|---|---|---|---|
| Alarm | Low | High | Low | High |
| Set | High | High | High | High |
| Set | Low | Low | Low | Low |
| Out of Service | High | Low | High | Low |

Table 1 above represents three possible response patterns by the levels high or low, on each of the conductors 105 through 108 of the receiver in accordance with the possible condition or status of each particular protection zone. An out of service condition represents a complete absence of any reply pulses from a particular protection zone, and may occur, for example, when the telephone lines to the transponder of a particular protection zone have been cut, or when the particular protection zone transponder is not in use or operating correctly. Under such circumstances, the input to RAM 1 is held low due to the lack of reply pulses, and the response pattern for this out of service condition makes the levels on 108 high, 107 low, 106 high and 105 low. Because each RAM inverts the level of signal applied to its inputs when the data is recorded in memory, the alternating level characteristic of the out of service condition results from the consistent low input to RAM 1. In an alarm condition, which represents the presence of a reply pulse in response to each interrogation pulse addressed to the particular protection zone in an alarm condition, the input to RAM 1 is always high, causing a response pattern of a low signal on conductor 108, high on 107, low at 106, and high at 105, opposite of that of the out of service condition. In a set or normal condition, each protection zone responds after every other interrogation pulse addressed to that particular protection zone. The set conditions of all high or all low as shown in Table 1 will now be described in conjunction with Table 2.

TABLE 2

| | CONDITION | | | |
|---|---|---|---|---|
| SCAN | 108 | 107 | 106 | 105 |
| Prior | High | Low | High | Low |
| Scan 1 | Low | Low | High | Low |
| Scan 2 | High | High | High | Low |
| Scan 3 | Low | Low | Low | Low |
| Scan 4 | High | High | High | High |
| Scan 5 | Low | Low | Low | Low |

The input to RAM 1 is low prior to the receipt of any reply pulses from a particular protection zone. Assuming that the transponder is in a condition to reply following the receipt of the first interrogation pulse addressed to that particular protection zone in a set condition, a reply pulse in the first scan will provide the outputs as shown for Scan 1. On Scan 2 the transponder does not reply, and the outputs are as shown. The levels from the prior scan have been inverted and transferred to the next sequential memory output conductor. During Scan 3 the transponder associated with the particular protection zone makes a response, and the outputs are inverted and shifted to provide an all low condition during the third Scan. During the Scan 4, the logic levels are merely inverted, and in the set condition the logic levels on each successive scan are merely an inversion of the logic level of the prior scan as is shown. If the transponder associated with a particular protection zone had not been in a condition to respond after the first interrogation pulse as shown during Scan 1 in Table 2, four scans instead of three would have been required to cause the outputs on conductors 105 to 108 to represent the set condition.

The status detector as shown and described in FIG. 7 determines from the response pattern of each particular zone at conductors 105 through 108, the alarm status of each particular protection zone addressed. Once the alarm status is determined, this status is recorded in memory in the status detector, and any changes thereafter in the status cause a change of status signal to be produced on conductor 112. The status detector also provides information indicative of the alarm status of each particular protection zone.

The response pattern of the particular zone addressed is supplied in synchronism with the internal clock pulse count corresponding to the interrogation pulse addressed to a particular zone. If the particular protection zone is in the set condition, all inputs at conductors 105 through 108 will be identical, either all high or all low. The level of conductors 105 to 108 are applied to the input of NAND 5 simultaneously with the application of the internal clock pulses. In the set condition with all high levels, the output of NAND 5 goes low. The all low condition on conductors 105 to 108 is also representative of a set condition; however, this all low condition is ignored as the all high level is sufficient for recognition of the set status. Referring to Table 1, the alarm condition is represented by high levels on conductors 105 to 107 and low levels on conductors 106 and 108. INV 2 and INV 3 respectively invert the low levels on 106 and 108 and apply their outputs to the input of NAND 6. In an alarm condition in conjunction with the clock pulse on conductor 103, the output of NAND 6 goes low. In an out of service condition, conductors 105 and 107 are low while 106 and 108 are high. INV 4 and INV 8 respectively invert the levels on conductors 105 and 107 and apply them to the input of NAND 7. In this out of service condition in conjunction with the lock pulse on conductor 103, the output of NAND 7 is low. Thus, from the foregoing, it is seen that low outputs are provided from NAND 5, NAND 6 and NAND 7 when the response pattern on conductors 105 to 108 indicates set, alarm and out of service conditions, respectively.

The outputs of NAND 5, NAND 6 and NAND 7 are respectively applied to RAM 5, RAM 6 and RAM 7, with the address of each RAM corresponding to the number of the particular protection zone being addressed. The RAMs are addressed by BC 4 and BC 5 connected in cascade with the input of BC 4 being the internal clock pulses on conductors 103. This arrangement of elements has previously been described and provides that the presence of a bit in the memory of any RAM at an address corresponding in count to the interrogation pulse number addressed to a particular protection zone indicates the significance of a certain information. The outputs of NAND 5 in RAM 5 are applied to the input of NOR 5, as are the outputs of NAND 6 and RAM 6 to NOR 7, and NAND 7 and RAM 7 to NOR 7. The output of each RAM is an inversion of the signal supplied to its input when recorded in memory. Thus, if a change of status of a particular protection zone occurs, the input to NOR 5, NOR 6 or NOR 7 will change and a high output will be provided. The high outputs from NOR 5, NOR 6 or NOR 7 are respectively inverted by INV 5, INV 6 or INV 7. The outputs of INV 5, INV 6 or INV 7 are connected so that if one output goes low, the output of INV 11 goes high. High output from INV 11 triggers MMV 3 for a time determined by C 22 and a low signal appears on conductor 112 which indicates a change of status and also provides a write command for recording the new status in the memory of RAM 5, RAM 6 or RAM 7 according to the change of status which has occurred and also erases the old status.

Outputs indicative of the status of each particular protection zone is applied on conductors 109, 110 and 111 from the information available in RAM 5, RAM 6 and RAM 7, respectively. This information is also supplied to LH 1. If it is desired to provide a visual indication of this information, a coincidence pulse appears on conductor 117 when the particular protection zone is addressed which latches and holds the inputs supplied to LH 1 and provides output to bias either Q 12, Q 13 or Q 14 according to the status of a particular protection zone. A current path through one of Q 12, Q 13 or Q 14 lights the alarm, set or service lamps accordingly, FIG. 1*a*, and a visual indication is supplied.

Figure 8:
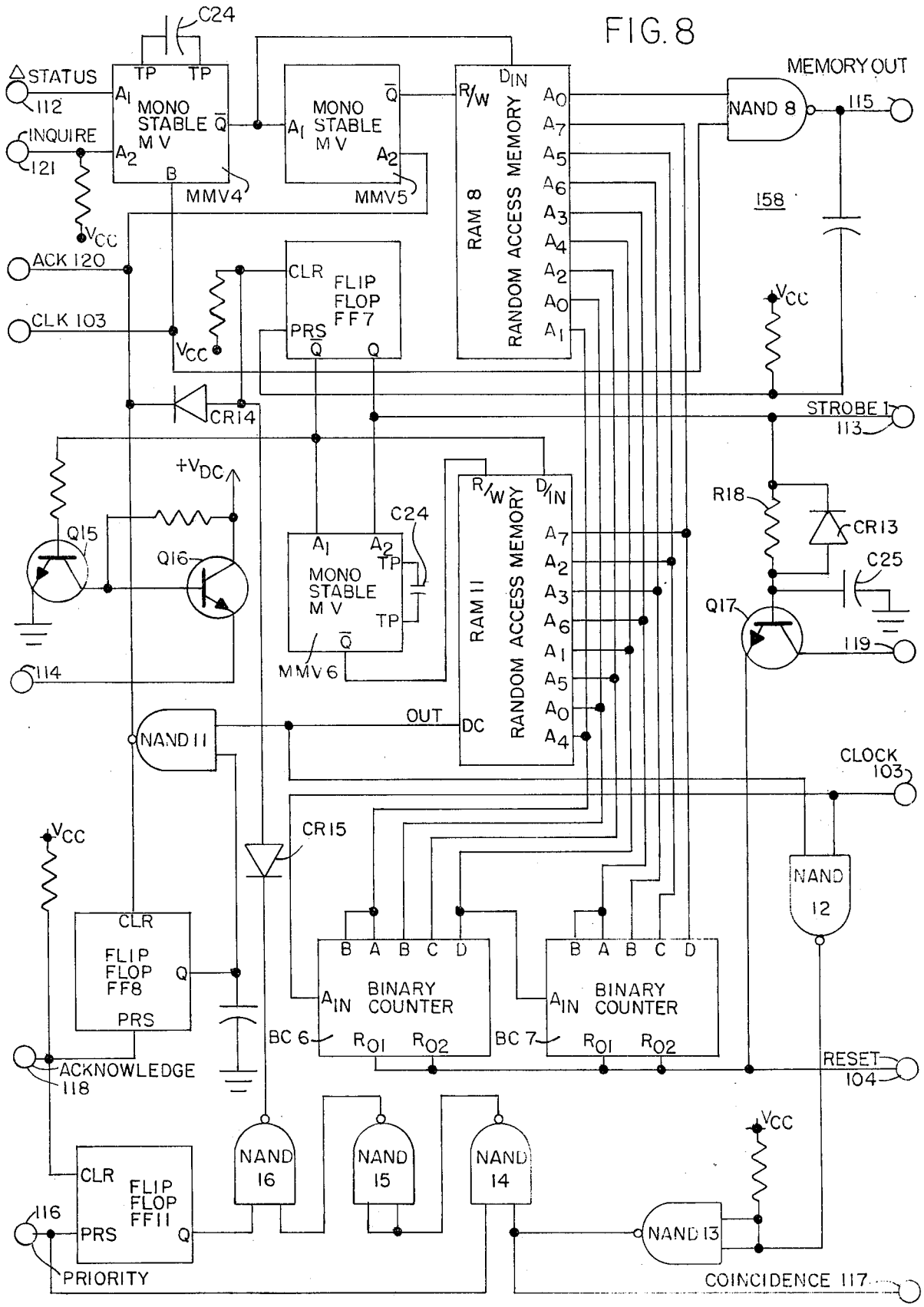
FIG. 8 is a schematic drawing of a preferred embodiment of a display memory forming a part of the present invention.

The display memory 158 is shown in FIG. 8. Change or status and inquiry signals appear respectively on conductors 112 and 121 as high-to-low transitions to the input of MMV 4. Either input will trigger MMV 4 for a time determined by C 23. The output of MMV 4 is applied to RAM 8 and to MMV 5. The output of MMV 5 provides a write signal to RAM 8 to record in memory the data appearing from the output of MMV 4. BC 6 and BC 7 provide memory address signals to RAM 8 and RAM 11 according to internal clock pulses in synchronism with interrogation pulses so that the memory addresses of RAM 8 and RAM 11 are the same as the number assigned to the particular protection zone being interrogated.

The output of RAM 8 is high, since inversion occurs internally, and is coupled with a clock pulse on conductor 103 through NAND 8 to provide a low output. The low output of NAND 8 is applied on conductor 115 to the function memory 160, FIG. 1*a*, where it is checked for the presence or absence of a priority or alarm condition, for example, fire or hold up. The output from NAND 8 is applied to the input of FF 7, where a change of status occurs on conductor 113 providing a strobe 1 signal to the display 159, FIG. 1*b*. The output from FF 7 is also applied to the input of MMV 6 which produces a low signal of time duration determined by C 24. Thus, a low signal from MMV 6 to the write input of RAM 11 is provided to record into RAM 11 the signal recorded in RAM 8, the signal in RAM 8 being indicative of a change of status or an inquire signal as received at conductor 112 or 121. Thus, when information is provided, RAM 11 has only one bit of information recorded at an address corresponding to the protection zone number. When such a signal is present in RAM 8, the Q output of FF 7 is low which causes Q 15 to be non-conductive and causes Q 16 to conduct current via conductor 114 for activating the dislay lamps as described.

The strobe 1 signal on conductor 113 activates the display 159 to display the number corresponding to the particular protection zone from which a change of status has occurred or to which an inquire signal has been addressed. Simultaneously, Q 16 supplies a current drive to activate the appropriate lamps, FIG. 12, indicating the status or condition of the zone and the type or function of protection of that zone. If this information is left unacknowledged for a predetermined amount of time, the audio alarm 166 is activated by Q 17 establishing a current path for that alarm through conductor 119. The Q output of FF 7 goes high upon the receipt of change of status or inquiry signals and begins to charge C 25 through R 18. After a predetermined time determined by the time constant of R 18 and C 25, Q 17 becomes conductive if the information remains unacknowledged. When FF 7 changes states, C 25 discharges rapidly through CR 13.

The information is provided until the operator acknowledges it by producing an acknowledge signal on conductor 118. The acknowledge signal on conductor 118 causes FF 8 to change states, and the output enables one input of NAND 11. The other input of NAND 11 is provided when BC 6 and BC 7 address RAM 11 and the sole signal indicative of the information displayed is provided at the output of RAM 11. It will be recalled that RAM 11 holds only one bit of information at the memory address corresponding to the number of the particular protection zone whose information is provided. The output of NAND 11, after the receipt of an acknowledge signal, goes low to reset FF 8, sends a command on conductor 120 to the printer memory 180, FIG. 1*c*, activates MMV 5 which erases the bit from RAM 8 at the address corresponding to the protection zone number being displayed since there is no input, and is coupled through CR 14 to clear or change the level of FF 7. The newly changed state of FF 7 removes the strobe 1 signal from conductor 113 and retriggers MMV 6 which, according to the previously described process, erases the bit from RAM 11 at the memory address corresponding to the zone number acknowledged. Thus, it can be seen that when an acknowledge signal on conductor 118 is applied, the bits in RAM 8 and RAM 11 indicative of information displayed are erased, and the display is cleared for the application of other information for display. The only information stored in RAM 11 is a single bit at the particular memory address corresponding to these protection zones to which an inquiry pulse has been addressed or from which a change of status has occurred. This high output or bit of RAM 11 is applied as one input to NAND 12, and the internal clock pulses are applied as the other input of NAND 12 via conductor 103. The output of NAND 12 goes low when the count of internal clock pulses corresponds to the number of the particular protection zone whose information is provided. The low output of NAND 12 is coupled through NAND 13 where it is inverted, and the output forms the coincidence pulse appearing on conductor 117. As previously described, the coincidence pulse on conductor 117 latches the data supplied to lamps 155 through 157 at the status detector 154. The current supplied conductor 114 thus activates the appropriate lamp 155 to 157 as controlled by the status detector 154 and also the type or function lamp associated with function memory 160, FIG. 1*a*, to complete the visual indication of the information provided.

The signals on conductor 115 are in synchronism with the bits recorded in RAM 8 indicative of change of status or inquire signals. These are continually applied to the function memory 160, and when the function memory determines that a particular protection zone number being displayed is not of a priority and that a bit has been introduced into RAM 8 indicative of a priority status of information to be displayed, the function memory supplies a signal on conductor 116 to cancel the non-priority information and substitute the priority information. The signal on conductor 116 is a high-to-low transition which provides an output from FF 11. The priority signal at conductor 116 occurs at the count corresponding to the number of the particular protection zone whose information is provided, and thus two high inputs are supplied to NAND 14. The low output from NAND 14 is inverted by NAND 15 and consequently two high inputs are provided to NAND 16. The low output from NAND 16, signifying the presence of a priority signal to be displayed in preference to a non-priority signal, is coupled through CR 15 to FF 7, where the output of FF 7 is changed, CR 14 prevents the application of the low signal to MMV 5 or conductor 120. The change of states at FF 7 due to the priority signal on conductor 116 eliminates the strobe 1 signal on conductor 113 and activates MMV 6. The MMV 6 output erases the previously recorded non-priority bit in RAM 11, eliminating the non-priority information display but not erasing the non-priority number information from RAM 8. The priority signal on conductor 116 remains until the output of NAND 8 on conductor 115 signifies that an output from RAM 8 representative of priority information at a particular zone number has been addressed. Upon addressing priority information, the signal at conductor 116 is removed and NAND 14 is disabled, allowing the display of this priority information in the manner previously described. Once priority information has been provided, an acknowledge signal on conductor 118 is required to clear FF 11, FF 8, RAM 8 and RAM 11. After acknowledgement, other priority information will be provided in the same manner, and thereafter the non-priority information will be provided.

The foregoing description of the display memory shows that change of status signals and inquire signals are entered into a first memory (RAM 8) at an address corresponding to the zone number from which a display may be initiated. A signal is set into a second memory (RAM 11) at the same address when information is provided. The signal from the second memory is used for providing the information so that if the information provided is of a non-priority nature, priority information may be provided without erasing the non-priority information from the first memory. The second memory is also used to cancel the information from both memories when an acknowledgement signal by the operator occurs.

Figure 9:
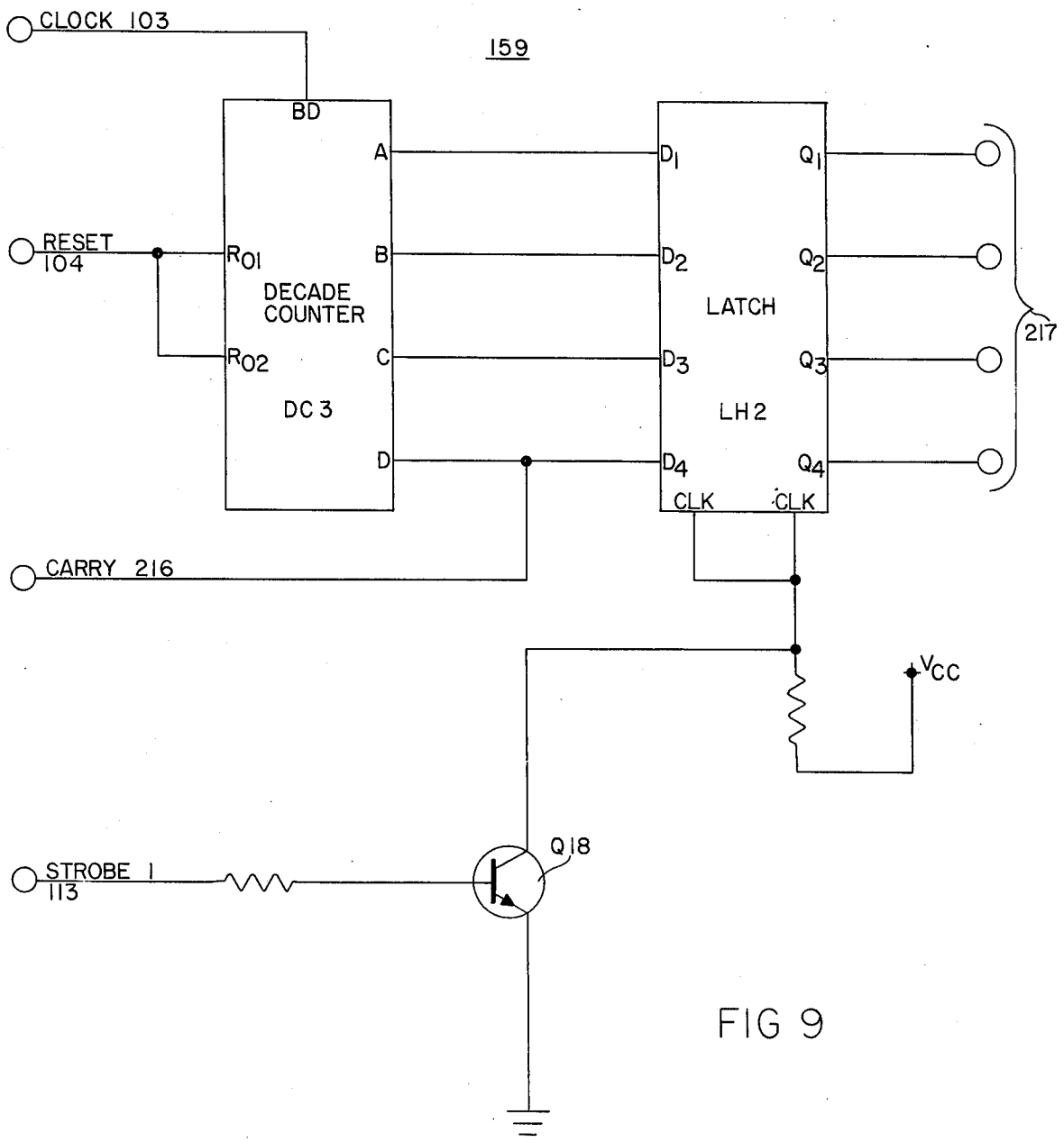
FIG. 9 is a schematic drawing of a preferred embodiment of a display forming a part of the present invention.

Referring to FIG. 9, there is shown one portion of the display 159. The display consists of three portions essentially identical to that shown in FIG. 9, and each section provides a binary coded output at 217 to a seven segment decoder display such as that manufactured by Dial Light, or the like. The strobe signal received on conductor 113 is common to all portions. The internal clock pulses on conductor 103 are applied to DC 3, whose outputs are supplied as inputs to LH 2. A signal on conductor 216 indicates the number of 10's of internal clock pulses, and the output on conductor 216 is applied to the input of the next portion of the display 159, not shown, in essentially the same manner that input is provided to DC 3 on conductor 103. In this manner three segments are provided, the outputs of which represent the number of each protection zone being addressed consecutively by the internal clock. A reset signal appearing on conductor 104 resets all three decode counters. When it is desired to display a number, the strobe 1 signal on conductor 113 causes Q 18 to be conductive and the binary coded count information applied to the input of LH 2 is seized and provided at the output on conductors 217 for activating the seven segment display of the decoder. The strobe 1 signal on conductor 113 is applied only when a change of status signal or an inquiry signal is received by the display memory 158, and the strobe 1 signal occurs at the internal count corresponding to the particular protection zone addressed whose information it is desired to provide. When the strobe 1 signal from conductor 113 is removed, the outputs at conductor 217 are no longer available from LH 2, and the visual display is erased.

Figure 10:
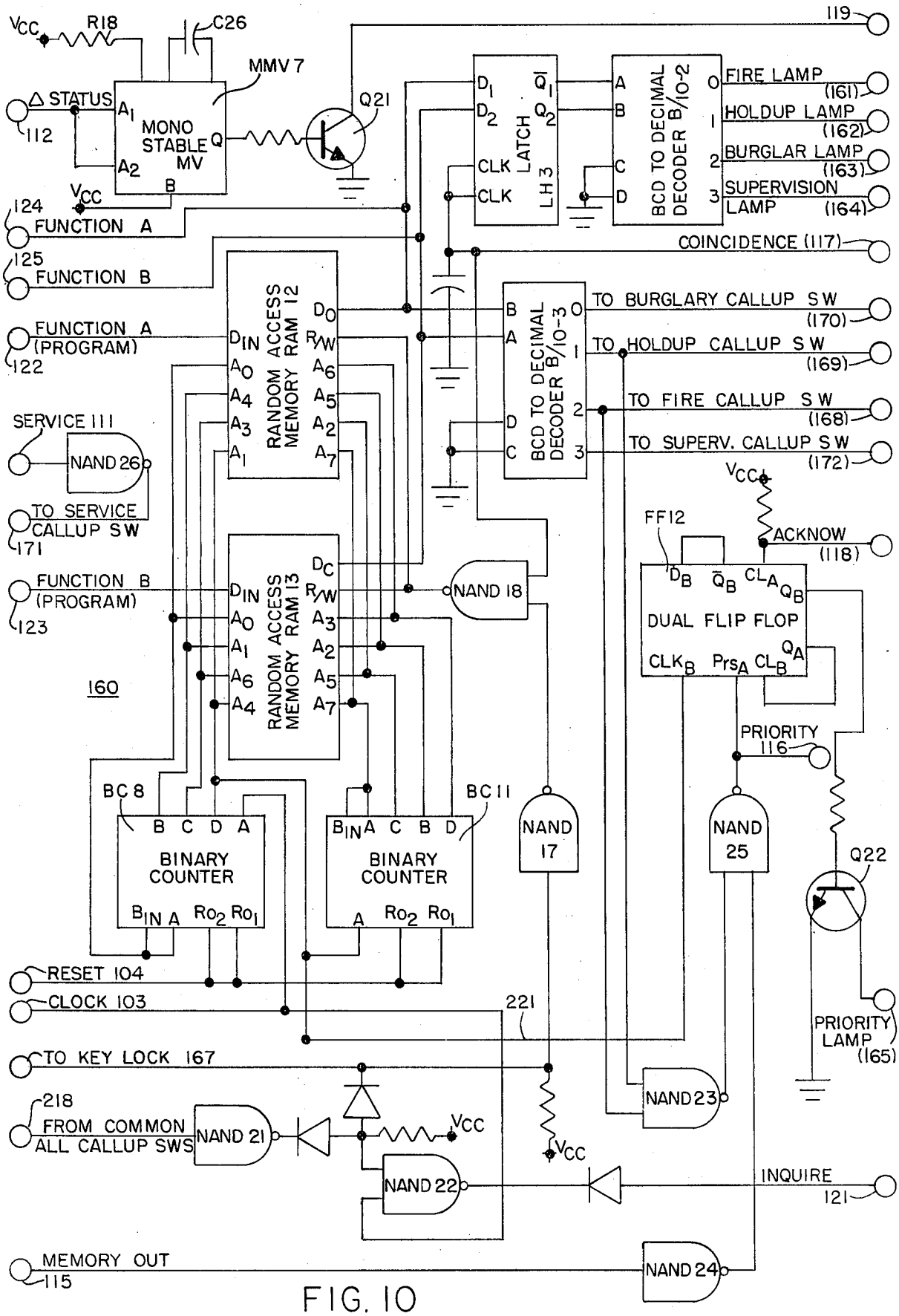
FIG. 10 is a schematic drawing of a preferred embodiment of a function memory forming a part of the present invention.

A preferred embodiment of the function memory 160 is shown and described in conjunction with FIG. 10. Change of status signals cause high-to-low transitions on conductor 112 which trigger MMV 7. The output of MMV 7 goes high for a short time determined by C 26 and R 18 which causes Q 21 to become conductive, thereby providing a current path through conductor 119 to the audio alarm 166. By this arrangement, changes of status *s* recognized by the status detector 154, FIG. 1*a*, cause a short audio signal to alert the operation of such changes.

The type or function of each particular protection zone is designated by the assignment of a number 0 to 3 to represent one of four possible types of function in the present embodiment: burglary, hold up, fire or supervision. The numbers 0 to 3 are applied in binary form on conductors 122 and 123 to the inputs of RAM 12 and RAM 13 to program the indication of the function. RAM 12 and RAM 13 are addressed by BC 8 and BC 11 which are cascaded and receive the internal clock pulse input signals on conductors 103. In this manner, the address at each RAM corresponding to the particular protection zone number interrogated, and the presence or absence of bits in the same memory locations of RAM 12 and RAM 13, represent in binary form the function of each particular protection zone. To program RAM 12 and RAM 13 according to the type of function to be assigned to a particular protection zone, the key lock switch 167, FIG. 1*a*, is activated to conduct a low signal to the input of NAND 17. The high output of NAND 17 is applied as one input to NAND 18. It will be recalled that the coincidence signal appears on conductor 117 when the count of internal clock pulses matches the number assigned to a particular protection zone; hence, the memory address of RAM 12 and RAM 13 likewise corresponds to this count number. At this count, the coincidence pulse appears on conductor 117 and the output of NAND 18 goes low to allow the presence or absence of bits on conductors 122 or 123 representing function assignment of that particular protection zone whose number corresponds with the count of internal clock pulses to be entered into RAM 12 and RAM 13. Since the number of the particular protection zone must be displayed on the display 159 before coincidence pulse can occur, the number of the particular protection zone is always determined before its function assignment can be entered or altered.

The outputs of RAM 12 and RAM 13, representing the function assignments of each protection zone, are applied to LH 3. When the coincidence pulse is supplied, the binary coded function assignment from RAM 12 and RAM 13 is latched at the output of LH 3, and B/10-2 decodes this function assignment to provide a current path to only one function lamp corresponding to the function assigned to the particular protection zone corresponding to the internal clock pulse count when the coincidence pulse is received. In this manner a visual indication of the function is provided.

The binary coded function assignments from RAM 12 and RAM 13 are also applied to B/10-3, which decodes these outputs in decimal form and applies them to the function call-up switches. The call-up switches cause the information relative to every zone assigned a particular function to be provided. When one of the call-up switches is depressed, a signal path is provided from the output of B/10-3 through the depressed call-up switch to conductor 218. As the internal clock pulse count consecutively addresses the memory addresses of RAM 12 and RAM 13, the counts that correspond to those particular protection zones having the function assignment of the closed call-up switch cause low signals to be applied to conductor 218 which provide corresponding high outputs from NAND 21. The high outputs from NAND 21 in conjunction with the positive clock pulses on conductor 103 cause NAND 22 to provide a low inquire signal on conductor 121 whenever protection zones having that function assignment corresponding to the depressed call-up switch are addressed. In this manner, the information relative to each protection zone assigned a certain function may be provided.

The priority function assignments are hold up and fire, and these functions appear on the outputs of B/10-3 routed to their corresponding call-up switches. When a low signal priority output is provided from B/10-3, the output of NAND 23 goes high. With non-priority outputs from B/10-3, the output of NAND 23 is low. Low signals arriving on conductor 115 from the display memory 158 indicate the necessity of displaying information relative to a particular protection zone as a result of change of status or inquire signals. A low signal on conductor 115 is inverted by NAND 24 at a system count corresponding to a number of the particular protection zone whose information is to be displayed. If any of the information in the display memory 158 is of a priority nature, both inputs to NAND 25 are high and the output at conductor 116 of NAND 25 goes low to signal the display memory 158 that it contains priority information to be displayed in preference to non-priority information. A low output from NAND 25 causes the first portion of dual FF 12 to change states, and the output of the first portion is applied to cause the second portion to allow it to be toggled on and off according to the pulses applied on conductor 221 from BC 8. The on and off operation of the second portion of dual FF 12 switches Q 22 on and off accordingly and causes the priority lamp to flash signalling the presence of priority information in the display memory 158.

The output from the status detector 154, FIG. 1*a*, indicating an out of service condition appearing on conductor 111 is inverted by NAND 26 and applied to the service call-up switch 171. This functions in a manner similar to that described for the other call-up switches to provide an inquire pulse on conductor 121 in accordance with each protection zone which is out of service.

Figure 11:
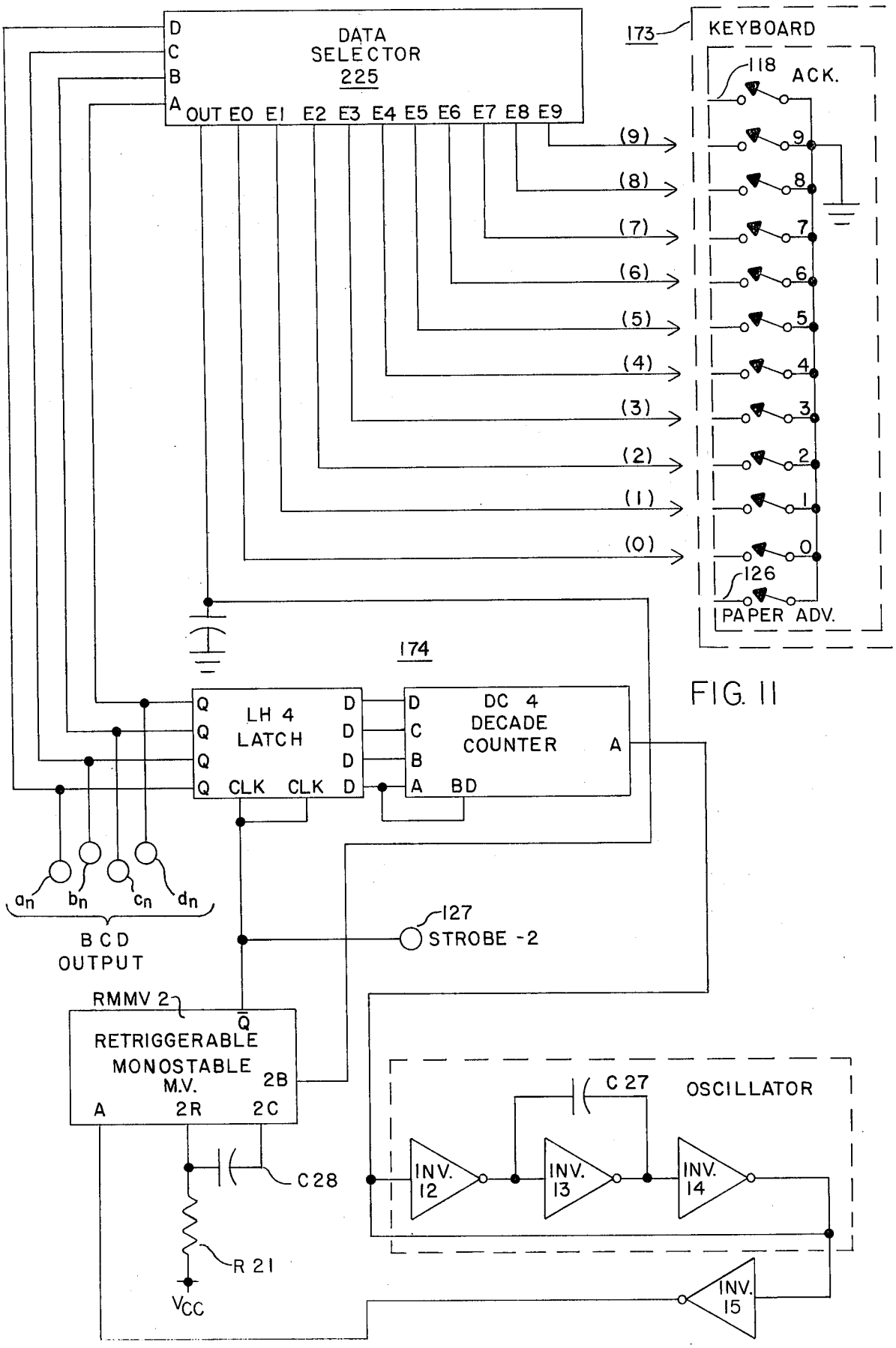
FIG. 11 is a schematic drawing of a preferred embodiment of a binary coded decimal converter forming a part of the present invention.

The BCD converted 174 is shown and described in conjunction with FIG. 11. The converter accepts switch closure inputs from the keyboard through the keyboard socket 173 and provides the binary coded decimal equivalent on conductors $a_n$, $b_n$, $c_n$, and $d_n$, FIG. 1*b*, so long as a key on the keyboard is depressed. INV 12, INV 13 and INV 14 in conjunction with C 27 form an oscialltor continuously operating at a high frequency. The output from the oscillator is applied to the input of DC 4 which increments at the frequency of the oscillator and provides outputs in BCD format from 0 to 9. The BCD outputs from DC 4 are applied to the input of LH 4 which passes these BCD coded signals through to the input of a data selector 225, so long as there is not received a signal to command the latching of the particular data by LH 4. The BCD coded inputs to the data selector 225 address in BCD format each of the decimal data selector inputs 0 to 9 from the corresponding conductors connecting the associated keyboard switches. The data selector is thus continually scanning its 0 to 9 inputs under control of the applied BCD from DC 4, and when a key depression connects one input to the data selector to reference potential through the keyboard switch, the output from the data selector goes high. The high output from the data selector enables RMMV 2 and the pulses from the oscillator pass through INV 15 to keep RMMV 2 triggered so long as the output signal from the data selector is present. The time constant of RMMV 2 set by R 21 and C 28 is greater than the period of the oscillator frequency. The low strobe 2 output on conductor 127 is provided to signal the depression of a key and to cause LH 4 to latch the BCD signal on conductors $a_n$ through $d_n$ corresponding to the keyboard key depressed.

Figure 1C:
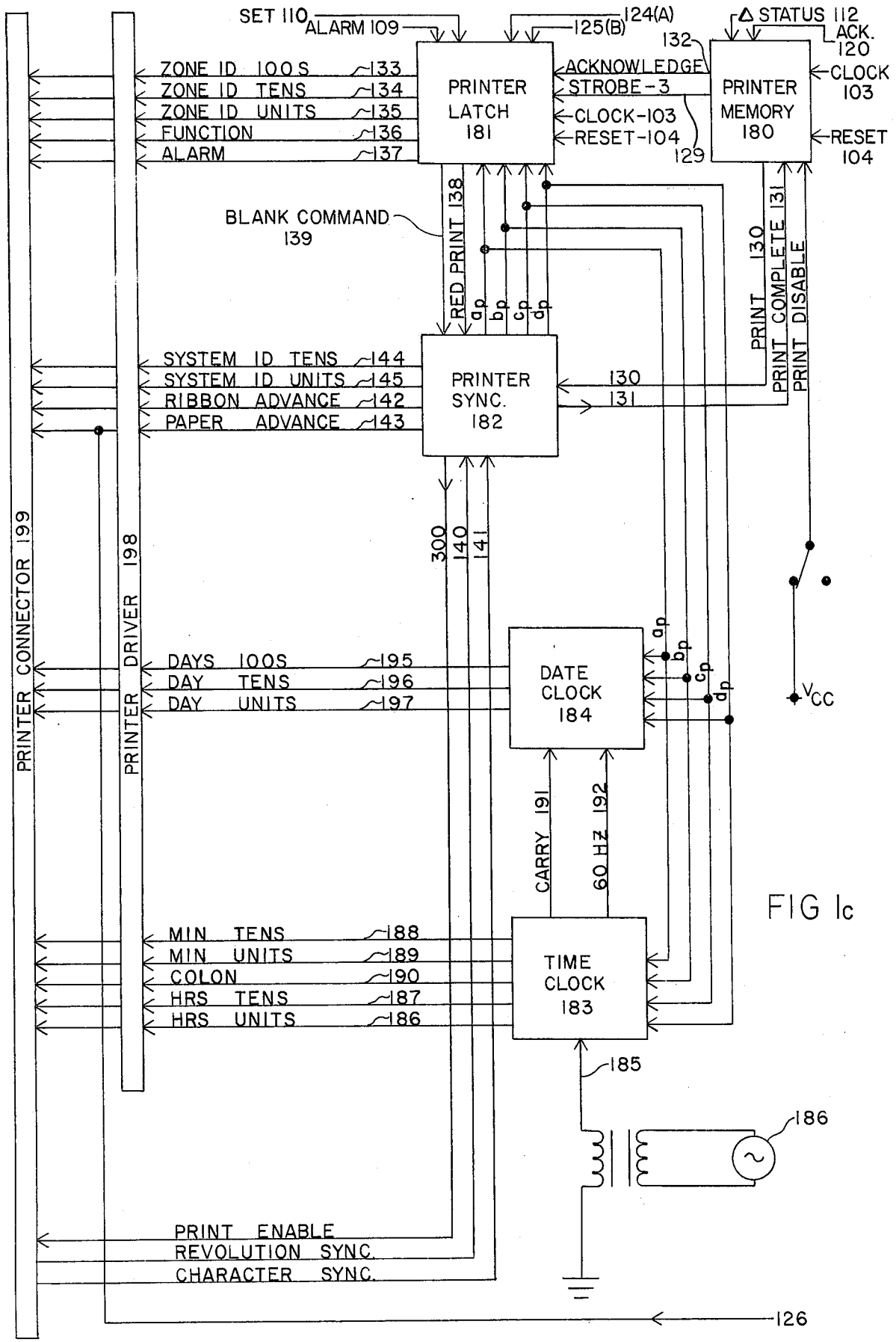

As can be seen from the block diagram of FIG. 1*b*, the function program switches are connected in parallel with the signals from keyboard switches 0, 1, 2, 3, and are used to program the function memory 160 with a binary coded information of the function assigned to a particular protection zone as has been described. Depression of the function program switches operates in a manner similar to that of depression of one of the keyboard number switches.

Figure 12:
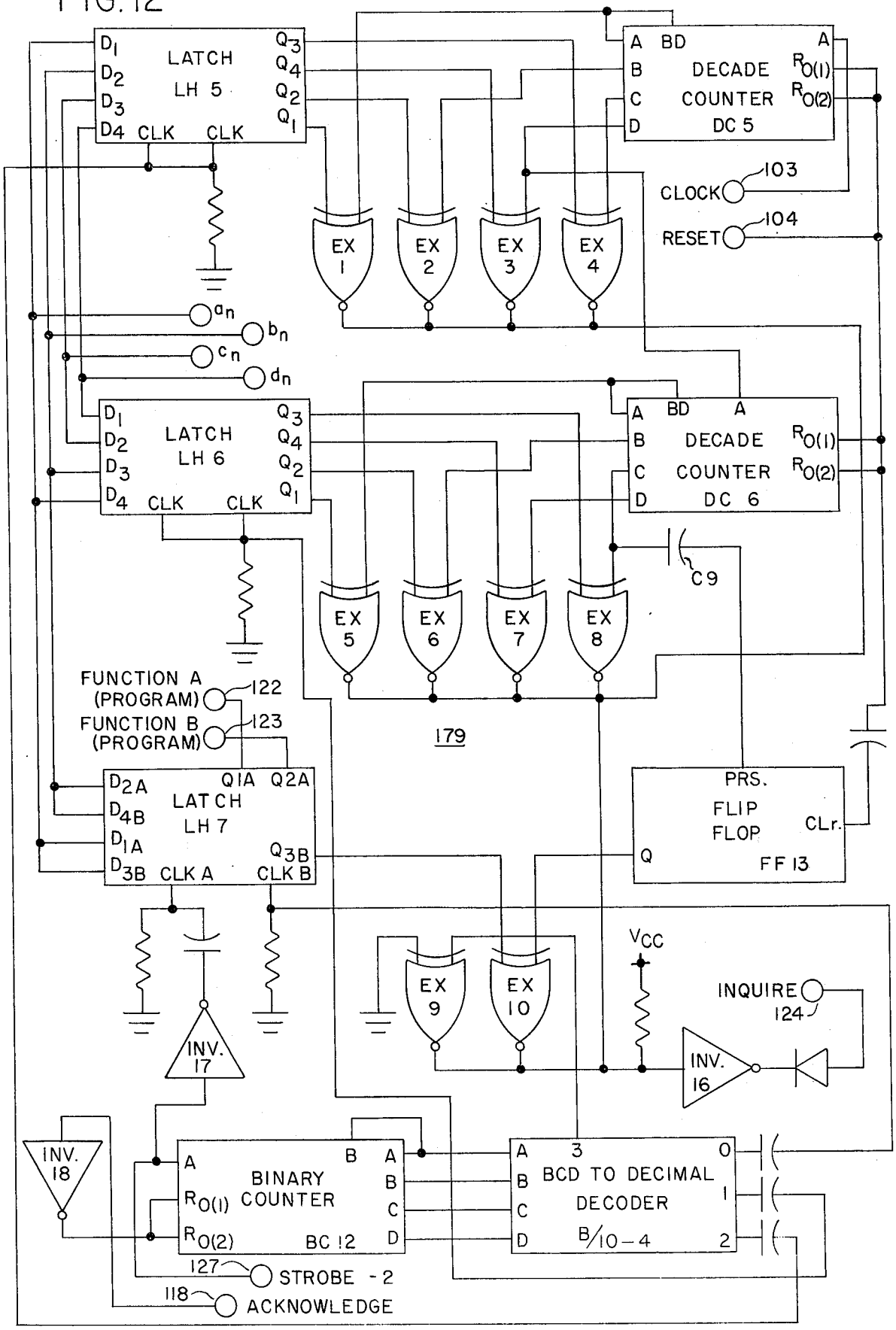
FIG. 12 is a schematic drawing of a preferred embodiment of a keyboard register forming a part of the present invention.

The keyboard register 179 of FIG. 12 stores the three number entry of the keyboard representative of a particular protection zone and sends an inquire pulse on conductor 121 when the internal clock pulse count matches the particular protection zone whose number is being displayed. The keyboard register 179 also receives programming information from the function program switches connected in parallel with certain of the keyboard switches, and supplies the programming information to the function memory on conductors 122 and 123.

The strobe 2 signal on conductor 127 from the BCD converter 174, FIG. 1b, is applied to BC 12, and the outputs of BC 12 increment with each depression of a key from the keyboard determined by the strobe 2 signal. The binary output of BC 12 is decoded to decimal form by B/10-4. The 0, 1 and 2 outputs of B/10-4, respectively, latch LH 7, LH 6 and LH 5 causing the outputs of these latches to hold the input that was applied to them when they received the latch signal. The binary coded form of each digit of the three digit zone number is present on conductors $a_n$ through $d_n$ when the strobe 2 signal is received on conductor 127. The first strobe 2 signal causes the number representing the first keyboard depression to be latched at the output of LH 5. The second keyboard depression causes the binary coded number to appear on conductors $a_n$ through $d_n$ and at the input of LH 6, and the simultaneously applied strobe 2 signal causes BC 12 to increment one number which is decoded by B/10-4 to supply a latch command to LH 6 thereby holding the second digit of the protection zone number. In a similar manner, LH 7 holds the third digit of the protection zone number.

DC 5 and DC 6 and FF 13 are incremented by the internal clock pulses appearing on conductor 103. The outputs of DC 5 and DC 6 and FF 13 represent and keep pace with the count of the internal clock pulses according to the protection zones interrogated, with DC 5 representing the units count, DC 6 representing the 10's count and FF 1 representing the 100's count. The Exclusive NOR comparators EX 1 to EX 10 collectively generate the inquire pulse when the internal clock pulse count represented by DC 5, DC 6 and FF 13 is the same of that number which has been called for from the keyboard. This number is represented by the outputs of LH 5, LH 6 and LH 7. To match the unit number, each corresponding binary output from LH 5 and DC 5 is applied to the input of one Exclusive NOR comparator. When a match occurs in the units of the number, the output of EX 1, EX 2, EX 3, and EX 4 are momentarily high during the duration of the internal clock pulse for that particular count. In a similar manner the corresponding 10's output from LH 6 and DC 6 are applied to the inputs of EX 5, EX 6, EX 7 and EX 8. The 100's output from FF 13 and LH 7 are applied to the input of EX 10. One input to EX 9 is connected to reference potential and the other input is from B/10-4. The input to EX 9 from B/10-4 goes low after the third key depression as determined by the strobe 2 signal to allow the output of EX 9 to go high. This is required so that the match between the internal clock count and that number originating from the keyboard will only occur after 3 digits representing the number of protection zones have been signalled from the keyboard and when the internal clock pulse count matches that number called for from the keyboard, all the outputs of EX 1 to EX 10 go high and cause a high input to INV 16 which inverts the signal and supplies the inquire pulse on conductor 121. Thus, when a match occurs the inquire pulse is generated which is recognized by the remainder of the system for the functions previously described.

Numbers representing the functions assigned to particular protection zones arrive on conductors $a_n$ and $b_n$ and are routed to LH 7. A latch command is generated for each strobe 2 command on conductor 127 by INV 17 for another portion of LH 7. The outputs from LH 7 representing the function appear on conductors 122 and 123. Since the function switches are connected in parallel with the 0 to 3 keys of the keyboard, part of the 0 to 3 keyboard depression when signalling a number of particular protection zone may effect on the outputs on conductors 122 and 123; however, these outputs are correctly set into LH 7 on the fourth strobe 2 command. The significant factor is that the function memory 160 will not accept the outputs on conductors 122 and 123 for programming the function until the function memory 160 receives a coincidence signal from the display memory of 158. The coincidence signal is not received until the protection zone number is provided by the display 159. After the coincidence signal is received, the key lock switch must be placed in position to cause the function memory to receive the function program data on conductors 122 and 123. By this time the fourth keyboard depression (function program) has occurred and the correct function data is provided from LH 7 on conductors 122 and 123. Acknowledge signals received on conductor 118 are inverted by INV 18 and applied to BC 12 to reset the counter and the latches and to make ready for the application of other signals from the keyboard.

The foregoing detailed description is related basically to the interrogation and response of transponders associated with particular protection zones, and how the response information is utilized to provide that information which is necessary or requested. The remainder of the detailed description will relate to providing the information in the form of a printed record through the use of a printer.

Figure 13:
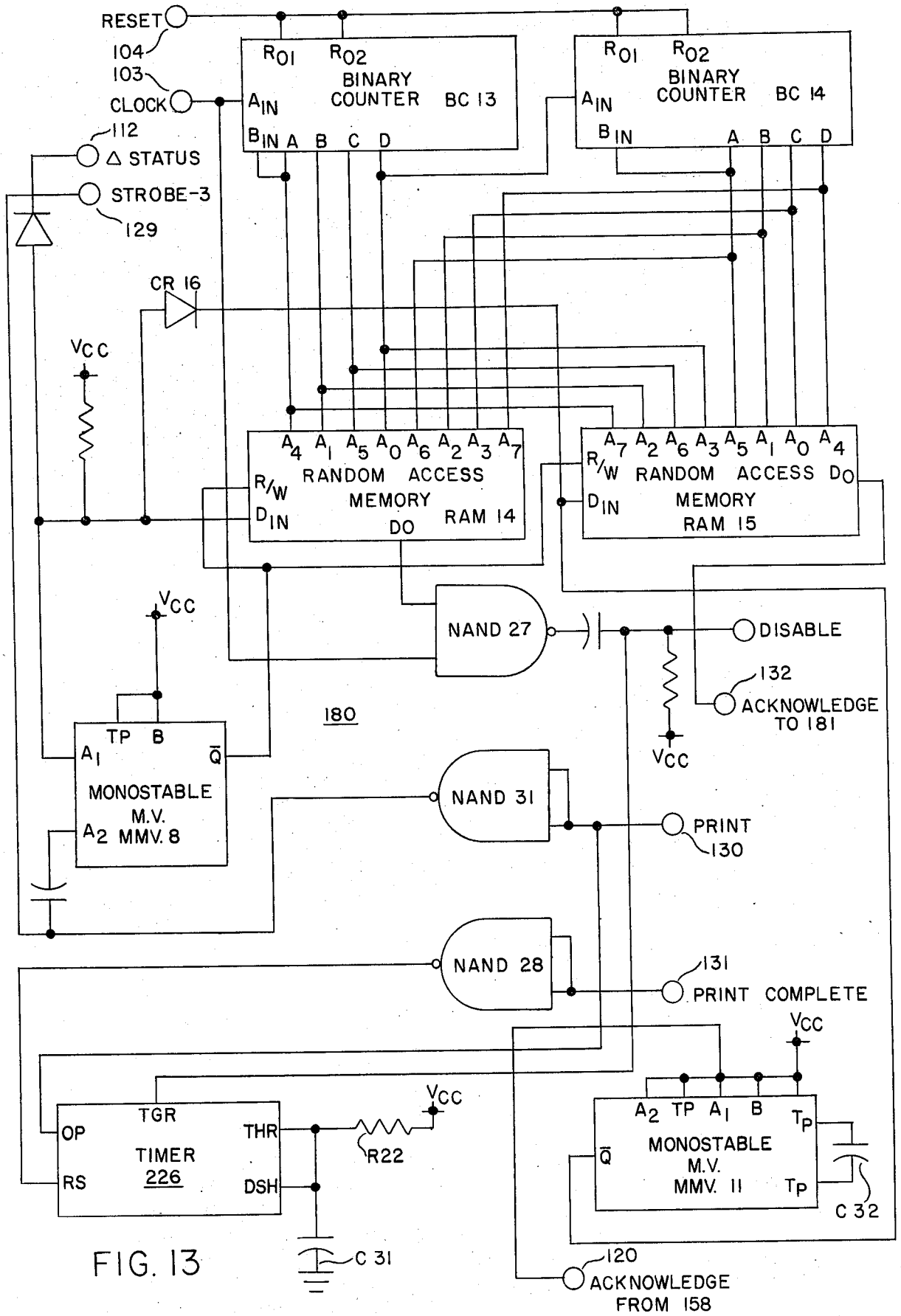
FIG. 13 is a schematic drawing of a preferred embodiment of a print memory forming a part of the present invention.

The printer memory 180 described in conjunction with FIG. 13 stores protection zone numbers and keyboard acknowledgement signals that are to be printed by the printer. If the printer is removed from service the printer memory will store the information which is to be printed and provides signals for printing this information when services are restored to the printer.

BC 13 and BC 14 are incremented according to the particular protection zone being interrogated. The outputs of DC 13 and DC 14 control the addressing of RAM 14 and RAM 15 so that the address of each RAM corresponds to the particular protection zone being interrogated, in the manner previously described. A low signal appearing on conductor 112 indicating a change of status triggers MMV 8 and applies input to RAM 14. The output of MMV 8 provides a signal to RAM 14 and RAM 15 to record the data applied at their respective inputs. The low input to RAM 14, once recorded, appears at the output of RAM 14 as a high signal which, in conjunction with a clock pulse on conductor 13, secures a low output from NAND 27 to trigger a timer 226. An output from timer 226 is provided on conductor 130 for a time determined by R 22 and C 31, or until a print complete signal is received on conductor 131 which will reset the timer 226 when inverted by NAND 28. The time constant determined by R 22 and C 31 is sufficient for the printer to print out all the information which must be printed, and generally, a reset signal coming from the output of NAND 28 will usually reset the timer 226 before a time constant of R 22 and C 31.

NAND 31 inverts the output of timer 226 and triggers MMV 8. MMV 8 again applies a signal to RAM 14 and RAM 15 to record the data at their respective inputs. When the second signal to record the data is received, the change of status signal on conductor 112 has passed and the input to RAM 14 is high which erases the bit from the memory from RAM 14.

If the printer is busy when MMV 8 is triggered by a change of status signal, the resulting output from NAND 27 will not trigger timer 226, and the timer will continue with allowing the printing of that information which was initiated prior to the receipt of the most recently occurring change of status signal. During the next scan, if the printer is not busy the signal entered into the memory of RAM 14 will again be applied to NAND 27 which will trigger timer 226, and at this time, the information resulting from the change of status signal on the previous scan will be printed out. In this manner RAM 14 stores signals of change of status signals to allow the information to be printed out at the appropriate earliest opportunity.

When the printer is disabled from service, a constant high level disable signal is applied to the trigger input of timer 226, causing it to effectively remain in a triggered state, and thus to cause RAM 14 to retain in memory all the information regarding change of status signals occurring when the printer is disabled. When the printer is returned to service, the information is printed out.

It is also desirable to print acknowledgements and the particular zone number to which the acknowledgement was addressed. An acknowledge signal on conductor 120 triggers MMV 11, and its output is applied to the data input of RAM 15 and to RAM 14 through CR 16. The output of MMV 11 also triggers MMV 8 which supplied a write signal to RAM 14 and RAM 15 to record the information. The acknowledge signal on conductor 120 arrives from the display memory 158, FIG. 1*a* when the count of the internal clock pulse is the same as that of the number of the particular protection zone for which the acknowledged information is to be printed. The bit entered in RAM 14 and RAM 15 is entered at address corresponding to the number of the protection zone for which the acknowledgement information is to be printed. With the acknowledgement information entered into RAM 14, the printing cycle as peviously described is initiated. During this cycle when the print signal is present on conductor 130 due to the triggering of timer 226, a signal of the acknowledgement is available on conductor 132 which is supplied to the printer latch 181 for processing to indicate an acknowledgement is to be printed for a particular protection zone. The acknowledgement information entered in RAM 14 and RAM 15 is erased in a manner previously described since MMV 11 has timed out as determined by C 32 and the inputs to RAm 14 and RAM 15 have gone high.

Figure 14:
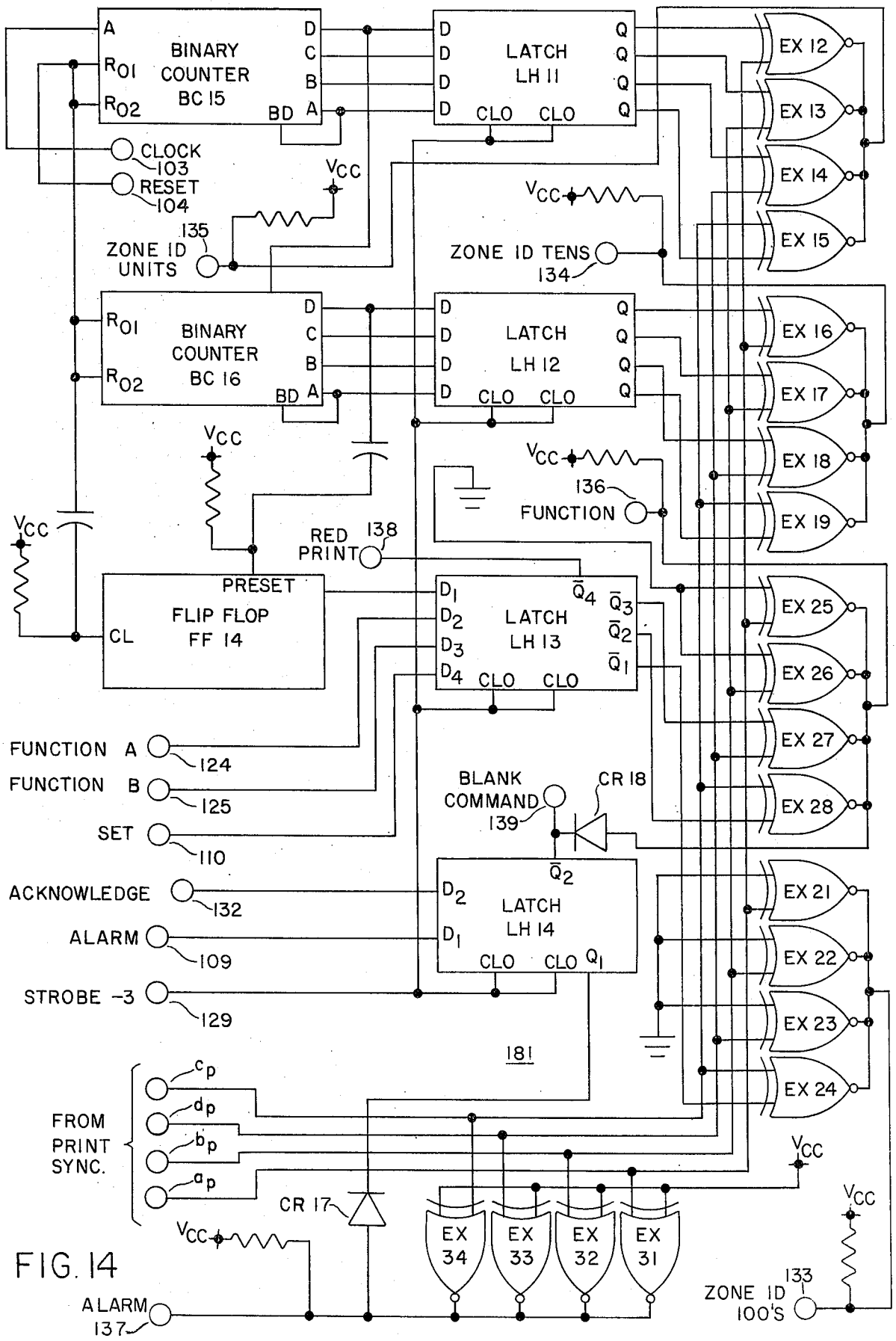
FIG. 14 is a schematic drawing of a preferred embodiment of a printer latch forming a part of the present invention.

The printer latch 181 described in conjunction with FIG. 14 seizes information relative to a particular protection zone when commanded to do so by the strobe 3 signal from the printer memory 180. The strobe 3 signal indicates the beginning of information to be printed and is supplied upon the receipt of a change of status signal applied to the printer memory 180. The information to be printed is held by the printer latch 181 until it can be printed by the printer. The printer latch also compares the data indicative of the position and thus, the characters of the printer drum and when a match of the information to be printed in relation to the characters on the printer drum occurs, output signals are provided to the printer driver 190 to cause the printing of the characters of information.

BC 15 and BC 16 and FF 14 are connected such that their outputs reflect the count of the internal clock pulses on conductor 103. The output from BC 15 and BC 16 and FF 14 are respectively applied to LH 11, LH 12, and one section of LH 13. Upon the receipt of a strobe 3 signal on conductor 129, the outputs of LH 11, LH 12 and LH 13 hold the information of the number of the particular protection zone corresponding to the count of the internal clock pulses. Data representing the function sssigned to a particular protection zone appears on conductors 124 and 125 in synchronism with the internal clock pulses count from the function memory 160 in the manner previously described. The function assignment data is latched into another section of LH 13 by the strobe 3 signal. Information indicative of an alarm or set condition for each protection zone appears on conductors 110 and 109 from the status detector, FIG. 1*a*, in synchronism with the internal clock pulse count correponding to the particular protection zone number addressed in the manner previously described. This status information is applied to another section of LH 13 and one section of LH 14, accordingly. Thus, when a strobe 3 signal is received indicating that the information relative to a particular protection zone whose number corresponds to the count of the internal clock pulses is to be printed, the outputs of LH 11, LH 12, LH 13 and LH 14 reflect the particular protection zone number, the condition of that zone, and the type or function assigned to that zone.

Signals are received on conductors $a_p$, $b_p$, $c_p$ and $d_p$ which are binary coded representations of the position and hence the characters which may be printed at that time by the printer drum. This information is supplied to one input of each gate EX 12 to EX 19, and EX 21 to EX 28. The outputs of each group of Ex 12 to EX 15, EX 16 to EX 19, EX 21 to EX 24, and EX 25 to EX 28 are wired together so that a match must occur between all inputs of each gate in ach group before the output of the particular group of comparators goes high. Thus, when the printer drum information on conductors $a_p$ through $d_p$ is the same as that information provided by LH 11, a signal is produced on conductor 135 to cause the printer to print the number of the protection zone units digit. In a similar manner when the match occurs for the protection zone 10's digit, a signal is applied on conductor 134, and for the 100's digit for protection zone number, a signal is supplied on conductor 132. A number representing the function is printed by a signal appearing on conductor 136 when the printer drum position corresponds to the number representative of the function. The alarm output of LH 14 is coupled through CR 17 to the common outputs of EX 31 to EX 34. A high level voltage is supplied to one input each of EX 31 to EX 34 and their collective output goes high when a count corresponding to an asterisk is attained by the printer drum, so long as the alarm output from L 14 is also high. If the alarm output from L 14 is low, CR 17 prevents the application of a signal on conductor 137. In this manner, an asterisk is not printed except under alarm conditions. The signal provided at conductor 138 is present under all conditions except when the set signal is present on conductor 110 to LH 13. Under set conditions, the printer is caused to print black.

When acknowledgement information is to be printed, an acknowledge signal is present on conductor 132 which is latched to the output of LH 14 upon the application of the strobe 3 signals. As was discussed in conjunction with the printer memory 180, during an acknowledgement print situation, the number of the particular protection zone acknowledged is printed, and this is provided to conductors 133 through 135 in the manner previously described. The acknowledge output of LH 14 is coupled to conductor 139 to provide the blanking command to the printer sync 182, and is coupled through CR 18 to prevent the printing of the function information on conductor 136. Thus described, the printer latch 181 provides the essential information to the printer regarding the number of the particular protection zone, its function, and its alarm condition also for acknowledgement printings.

Figure 15:
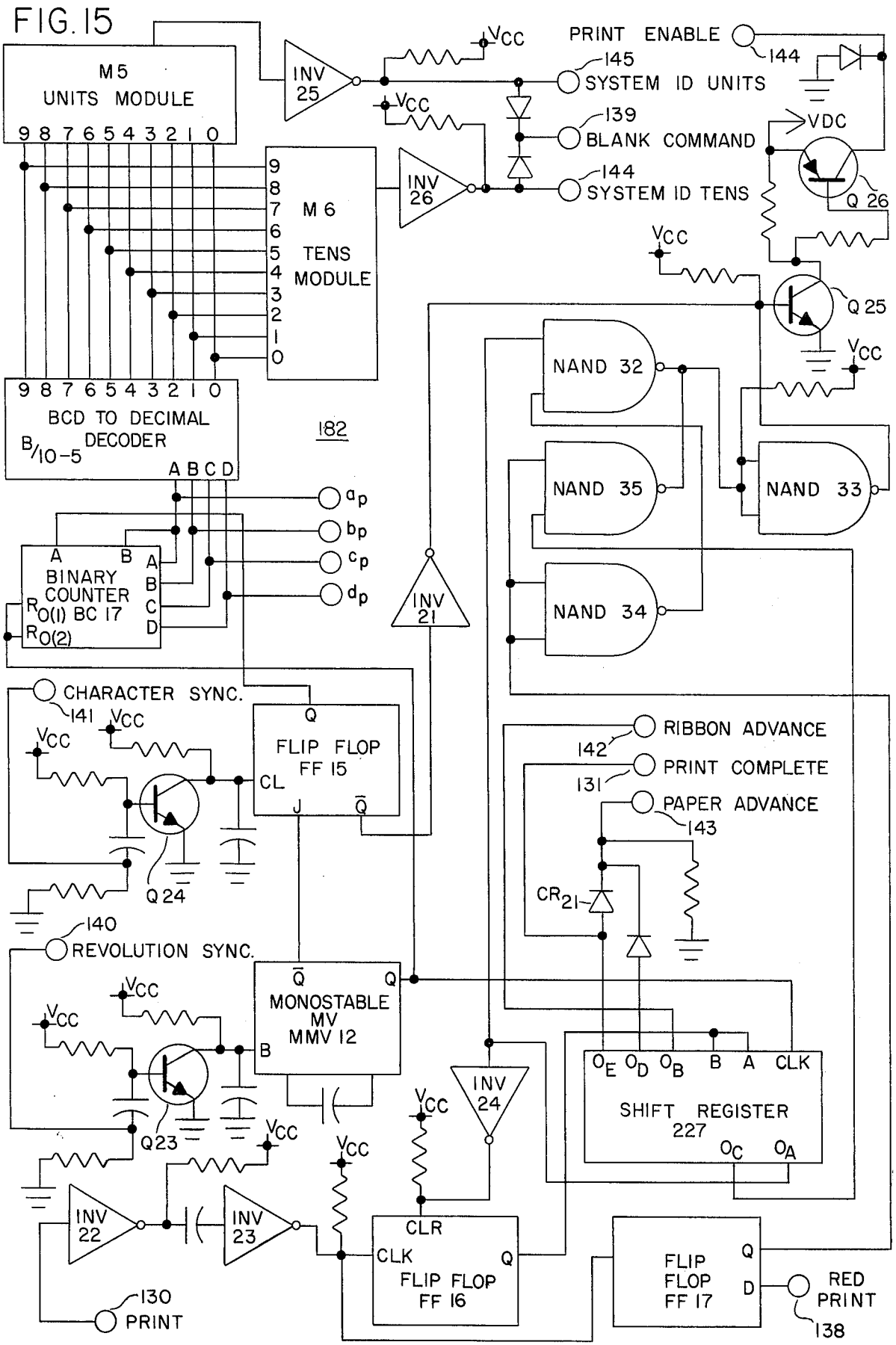
FIG. 15 is a schematic drawing of a preferred embodiment of a printer sync forming a part of the present invention.

The printer sync 181 of FIG. 15 synchronizes the mechanical rotation of the printing drum of the printer with the information signals to allow the proper characters to be printed on the paper by the printer, provides ribbon advance and paper advance signals to the printer, and provides a signal to the printer memory 180 to cause the information to be retained in that memory when the printer is disabled. The printer sync 181 also provides commands for printing a system number to identify the particular interrogation system from which the printed paper record has been provided.

In the preferred embodiment of the present invention, the printer used is a Seiko, model EP-101 manufactured by Sinshu Seiki Co., Ltd., Tokyo, Japan. To fully understand the operation of the printer sync, it is necessary to briefly describe the operation of the printer itself. A fuller understanding and description of the operation of the Seiko printer may be found in "Printing Mechanism, Model EP-101 Technical Instructions" by Shinshu Seiki Company, Ltd., Tokyo, Japan. The printer is arranged to print 21 columns of figures horizontally across a standard tape such as that used in an office machine. Printing is accomplished by causing a hammer to strike a ribbon onto the paper underneath of which is a rotating printing drum providing the proper character desired to be printed. The printing drum is a rotating cylinder having 21 columns with each horizontal row containing the same character. The printing drum rotates rapidly, and the objective is to cause the printer hammer to strike the paper and ribbon down on the character at the proper time when the desired character is in a correct rotational position. To achieve this, it is necessary for the printer sync 182, to determine the exact rotational position and hence the character of the rotating printer drum. This is accomplished by driving synchronization signals from the rotating printer drum. As the drum rotates, a revolution sync pulse is produced eaacg revolution when the rotational position of the drum is at the 0 character. Thereafter with each row of characters, for example, one, two, three .... etc., a character sync signal is produced to indicate the position of each successive character at the proper position for printing. In addition to the nine number characters on the printer drum, there are various other symbols such as plus, minus, asterisk, colon, etc. Thus, by knowing when each new revolution begins according to the revolution sync signal, the character sync signals reference each character on the printer drum. The relationship between the characters as they appear in rotational sequence on the printer drum and the number of character sync signals produced during each revolution secures correspondence between the electrical signals produced and the proper character on the printer drum for printing. The printer sync also provides signals to advance the ribbon, change the color of the ribbon, and advance the paper.

Revolution sync pulses from the printer are applied on conductor 140 and are coupled through Q 23 where inversion occurs to trigger MMV 12. A positive pulse output is applied from MMV 12 to BC 17 and to a shift register 227. The signal supplied to BC 17 resets this counter and makes it available to count character sync pulses appearing on conductor 141. The character sync pulses are coupled through Q 24 and cause FF 15 to provide an output to BC 17 in accordance with each character sync pulse received during each revolution. Thus, the binary coded output of BC 17 represents the position of the printer drum on conductors $a_p$ through $d_p$. The binary coded outputs from BC 17 are applied to B/10-5 which decodes these binary inputs to one of ten decimal outputs. The decimal outputs applied to M 5 and M 6, and the predetermined internal connections through these modules provide signals of a 10's digit and units digit. The units digit signal is inverted by INV 25 and supplied at conductor 145. The 10's digit signal is inverted by INV 26 and supplied at conductor 195. The signals on conductors 144 and 145 will be effective so long as the signal at condutor 139 is high. As has been described in conjunction with the printer latch 181, a low signal blank command on conductor 139 holds conductors 144 and 145 low and prevents an effective output from conductors 144 and 145. When conductor 139 is high the signals on conductors 144 and 145 will provide a signal to the printer to print a number representative of the system. This is useful when a number of systems according to the present invention are in use simultaneously to monitor the condition of more than 199 particular protection zones, for example. The number associated with the particular system may be altered by changing the internal connections of M 5 and M 6.

Another output of FF 15 is supplied to the input of INV 21, the output of which controls the condition of Q 25 and Q 26 to provide the print enable signal on conductor 300. The print enable signal supplies a source of current to the printer hammer coils to cause the hammers to do the printing. In this manner, the printer hammers are enabled when the printer drum attains a position to produce a complete reproduction of each character as the printer drum rotates. This prevents the printing of partial characters or matter between characters on the printer drum. The conduction of transistors Q 25 and Q 26 is also controlled by the output of NAND 33.

A print command received on conductor 130 is conditioned by INV 22 and INV 23, and applied to FF 16. Upon receipt of the print command on conductor 130, FF 16 changes state and its output enables a shift register 227. During the first revolution sync signal that comes after receipt of the print command on 130, the output of MMV 12 is coupled to the clock input of the shift register 227 indicating that the printer is at the 0 beginning position of a revolution. The shift register is activated and the data from FF 16 is entered into the shift register at the first position of output at $O_a$. The $O_a$ output is applied to INV 24 whose output resets FF 16. During the first revolution of the printer drum any printing in black is accomplished since the ribbon position is black. This is achieved by allowing Q 25 and Q 26 to be conductive to provide the print enable signal on conductor 300 by keeping the output of NAND 33 high. This essentially is achieved by the absence of a red print signal on conductor 138 in the following manner. When the print command is received on conductors 130 this enables FF 17, and output of FF 17 is determined by the presence or absence of the signal on conductor 138. Assuming the absence of a red print signal indicating that a black print is to be accomplished during the first revolution, the output of FF 17 is low, and this low output is inverted by NAND 34 and supplied to the input of NAND 32. The coincidence of the high output from the shift register 227 in the first output position $O_a$ and the high output of NAND 34 cause the output of NAND 32 to be low. The low output of NAND 32 is inverted by NAND 33 which allows Q 25 and Q 26 to conduct as previously described to print black during the first revolution of the printer drum. During the second revolution MMV 12 provides a second clock pulse to the shift register 227 and the output is shifted to the second position $O_b$. No new data is entered from FF 16 since it has been reset by the signal from the first output $O_a$. The second output $O_b$ sends a signal on conductor 142 to the printer to advance and set the ribbon to a red position. During the third revolution of the printer drum, another clock pulse is received by the shift register from MMV 12 and an output is provided third position $O_c$. If the print is to be red, a red print signal would have been present previous to this on conductor 138 which would have caused the output of FF 17 to be high. The coincidence of the two high outputs to NAND 35 causes a low input to NAND 33 which allows Q 25 and Q 26 to be conductive as described. If black printing would have been caused during the first revolution, the output of FF 17 would have been low, the output of NAND 35 would be high, and the output of NAND 33 would have been low, thereby disabling Q 25 and Q 26. During the fourth revolution, the shift register output is incremented to $O_d$ which provides a signal to conductor 143 which advances the paper and also releases the ribbon back to the black position. During a fifth revolution, the output of the shift register is incremented to the fifth position $O_e$, and a print complete signal is supplied on conductor 131. An optional diode CR 21 may be coupled between conductors 131 and 143 in a manner shown as to provide a double space at the end of each printing sequence, if desired, by coupling the print complete signal also as the paper advance signal, thereby providing one additional paper advance signal.

Figure 16:
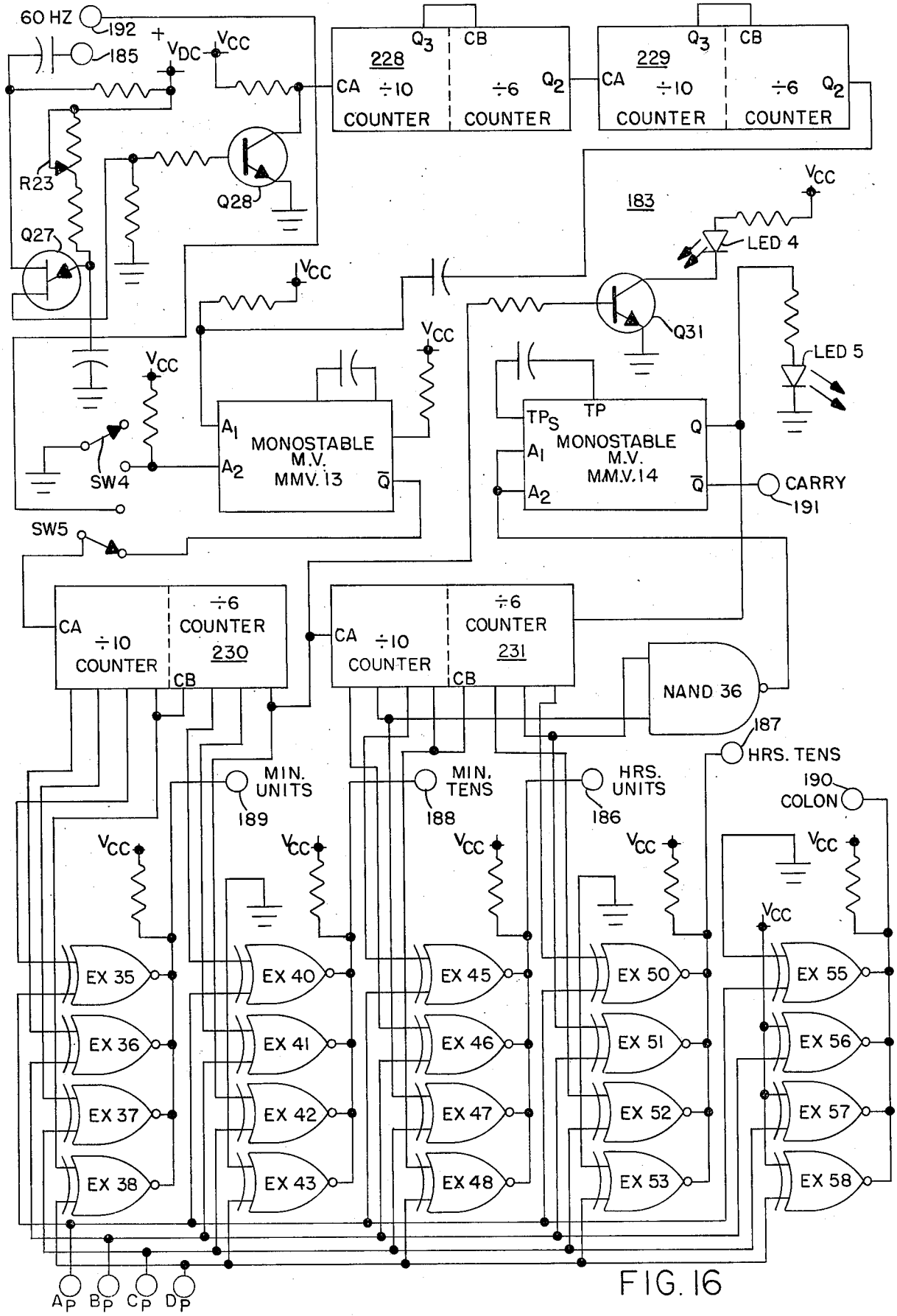
FIG. 16 is a schematic drawing of a preferred embodiment of a time clock forming a part of the present invention; and, FIG. 17 is a schematic drawing of a preferred embodiment of a date clock forming a part of the present invention.

The time clock 183 is described in conjunction with FIG. 16. Unijunction Q 27 forms a relaxation oscillator adjusted by R 23 to operate slightly below 60 Hertz. A 60 Hertz signal from a conventional power source is present on conductor 185 and causes Q 27 to switch at a 60 Hertz signal as determined by the specific frequency of the applied power. The output pulses from Q 27 are conditioned by Q 28 and are applied to the input of a counter 228 and on conductor 192 to the date clock, FIG. 17. Counter 228 has a divide by 10 section and a divide by 6 section, and these sections are coupled together so that counter 228 divides by 60. The output of counter 228 is thus a pulse every second which is applied to the input of counter 227 which compositely divides by 60 to provide an output pulse once every minute to the input of MMV 13. The output of MMV 13 is applied to the input of counter 230 which has a divide by 10 section and a divide by 6 section. The divide by 10 outputs of counter 230 are in binary coded form and are applied to the inputs of EX 35 and EX 38. These binary coded outputs of the divide by 10 section represent 0 to 9 minutes, and when these signals are compared to the signals on $a_p$ through $d_p$ representing the position of the printer drum, the composite output of EX 35 to EX 38 goes high to provide a signal on conductor 189 indicative of the minutes. The output of the divide by 10 section of counter 230 is applied to the input of the divide by 6 section of counter 230. The binary coded outputs of the divide by 6 section represent 10's of minutes, and these outputs are applied to EX 40 to EX 43. In a similar manner the printer drum position signals are applied to the inputs of EX 40 to EX 43, and when a match occurs a signal is produced on conductor 188 to secure printing of the 10's of minutes.

The output of the counter 230 represents 60 minutes, and it is supplied to the input of counter 231 and to Q 31. The signal to Q 31 causes LED 4 to omit light or blink once with the passage of each hour. The input to counter 231 is applied to a count by 10 section and the binary coded output of this section is compared by EX 45 to EX 48 to the printer drum position to provide a high signal on conductor 186 representative of the units of hours. A divide by 6 section of counter 231 provides binary coded output indicative of 10's of hours which is compared to the printer drum position by EX 50 to EX 53 to provide a signal on conductor 187 for 10's of hours. The appropriate outputs of counter 231 representative of 24 hours are applied to the input of NAND 36. When a count of 24 hours is reached NAND 36 activates MMV 14, and a carry signal is provided on conductor 191 to the date clock 184, FIG. 17. Another output of MMV 14 causes LED 5 to blink once with a passage of 24 hours, and this output also resets counter 231 to zero. The remainder of the counters 228, 229 and 230 need not be reset because they reach full counts and automatically reset.

One output to each EX 55 to EX 58 has been wired at a predetermined logic level so that when a match between the printer drum position and the predetermined logic levels occurs, a signal is provided on conductor 190 for the purpose of printing a colon between the hours and minutes printed.

Switches SW 4 and SW 5 are used for initially setting the counters when the system is installed. Switch SW 4 will increment the count of minutes by one in accordance with each depression to the position opposite that shown. Each depression causes MMV 13 to trigger once and thus increment the divide by 10 section of counter 230 by one minute. Switch SW 5 is provided for rapidly advancing the counters. Depression of SW 5 to the position opposite that shown will apply a 60 Hertz signal from the output of Q 28 to the input of counter 230. This rapidly advances the minutes and hours output of counters 230 and 231, and by counting the number of blinks of light from LED 4 and LED 5 the amount of advancement of the counters is readily determined.

Figure 17:
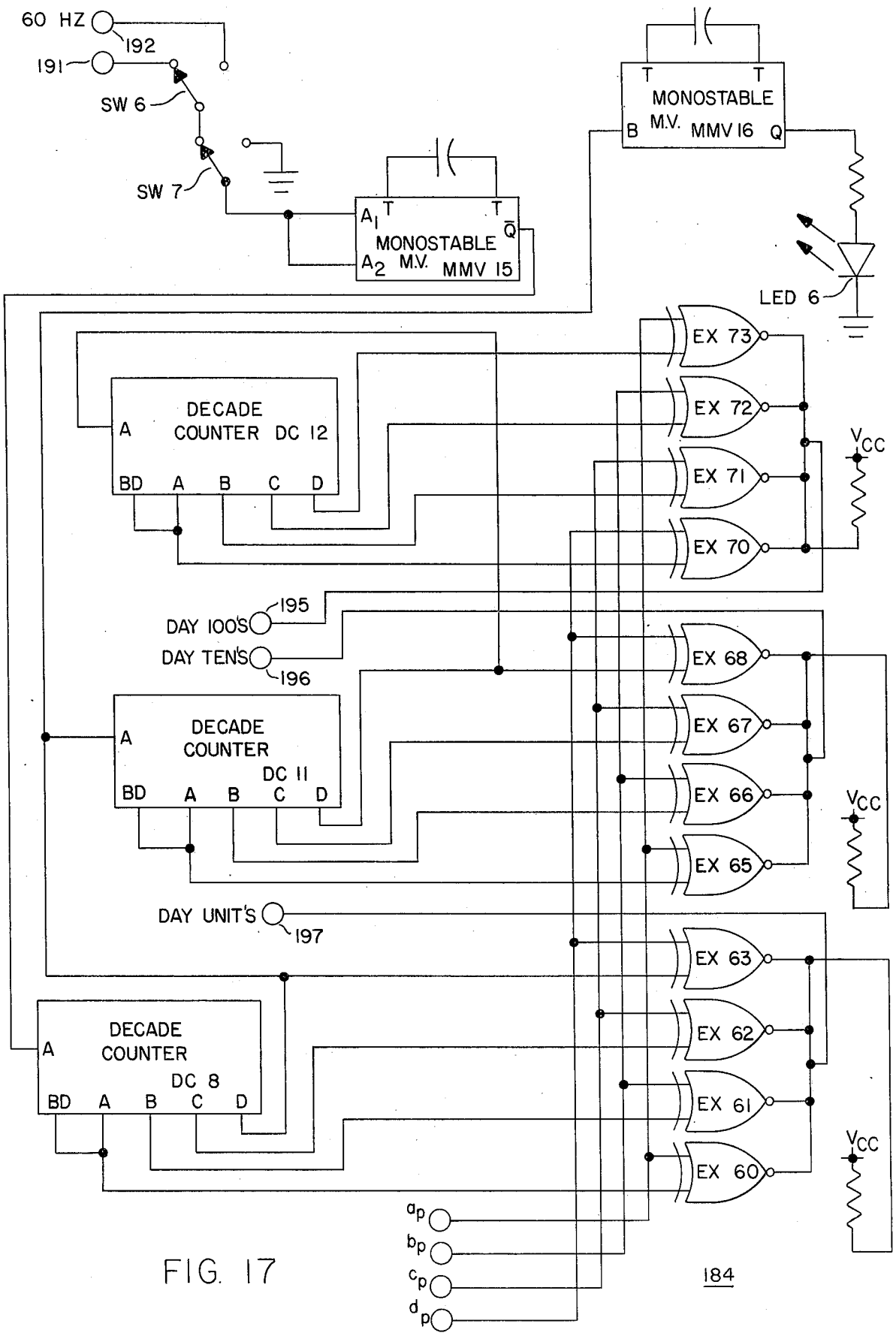

The date block 184 of FIG. 17 provides a three digit number indicating the day of the year for use by the printer. Carry pulses received on conductor 191 are coupled through switches SW 6 and SW 7 and trigger MMV 15. The output of MMV 15 is coupled to DC 8 which provides binary coded outputs representing 0 to 9 days. These outputs are compared by EX 60 to EX 63 to the printer drum location signals $a_p$ through $D_p$, and an output on conductor 197 representative of units of days is provided when a match occurs. An output from DC 8 is coupled to the input of DC 11 and to MMV 16. DC 11 provides a binary coded output in representative of tens of days and this output is compared by EX 65 to EX 68 to the printer drum location, and when a match occurs a signal is delivered on conductor 196. The output of DC 11 is coupled to the input of DC 12 which provides a binary coded output indicative of the hundreds of days to EX 70 to 73. In a similar manner when a match occurs a signal representative of the number of hundreds of days is provided on conductor 195.

Switch SW 6 is provided for rapidly incrementing the number of days registered by the date clock. Operation of switch SW 6 to the position opposite that shown applies a 60 Hertz signal from conductor 192 to the input of MMV 15. The output of MMV 15 rapidly increments DC 8, DC 11 and DC 12. The output of DC 8 coupled to MMV 16, causes LED 6 to blink with the passage of ten days. The amount of advancement of the date clock may be readily determined. Switch SW 7 when operated to the position opposite that shown increments the decode counter by one day.

The printer driver 198 is merely an amplifying and inverting section for each of the signals received to thereby condition those signals at the proper logic level and power level to be applied directly to the printer through the printer connection 199. For all signals received except the ribbon advance signal and the paper signal, simple logic circuit inverters may be used. For the ribbon advance signal and paper advance signal, considerable current must be supplied to the printer, so a transistor amplifier must be used to provide the considerable current switching capability necessary to activate the rather massive mechanisms causing ribbon advance and paper advance.

The individual elements described in the foregoing detailed description are conventional and well known by those skilled in the art. For further clarity of description, exemplary TTL integrated circuits which may prove satisfactory for use in the invention are listed below. Flip flops (FF) 1 to 4, 15 and 16 may be number 7473 and 5 to 14 and 17 may be number 7474. The binary counters (BC) may be number 7493. The decode counters (DC) may be number 7490. BCD to one of ten decoders (B/10) 1, 3, 4 and 5 may be number 7442, 2 may be number 74145 and 6 and 7 may be number 5617. The monostable multivibrators (MMV) may be number 74121, and the retriggerable monostable multivibrators (RMMV) may be number 74123. The

| | Number |
|---|---|
| Level detector 211 | 555 |
| Level detector and wave shaper 213 | 556 |
| Timers 251, 254 | 556 |
| Astable multivibrator 256 | 555 |
| Data selector 225 | 74150 |
| Timer 256 | 555 |
| Shift register 227 | 74164 |
| Counters 228, 229, 230, 231 | 14566 |

The foregoing description has described the present invention in general functional terms and in specific reference to the actual elements used in a preferred embodiment to provide the operation described. This description had readily shown that the present invention may be constituted of easily available and relatively inexpensive elements. Furthermore, the use of DC level interrogation and reply pulses, and the circuit arrangements for storage of information in the form of a bit located a memory address corresponding to the protection zone from which that bit of information is relevant, provide a relatively inexpensive interrogation system. Furthermore, the unique arrangement of the response pattern according to the predetermined number of scans of each particular protection zone reduces the amount of communication necessary between the central station and the transponders associated with each protection zone to further simplify the operation of the system. The response pattern also significantly reduces the chance of false alarm conditions; however, the present invention still rapidly communicates information of change of status conditions at a particular protection zone should such change of status occur.

The foregoing invention has been shown and described with particularity and it is probable that those skilled in the art will foresee changes and modifications without departing from the scope of the invention. Therefore, it is intended by the appended claims to cover all such changes and modifications as fall within the true spirit and scope of the invention.

What is claimed is:

1. In an interrogation and response system for monitoring the status of a plurality of protection zones of the type in which the protection zones are interrogated in sequence repeatedly by a series of interrogation signals, each sequential interrogation of all the protection zones constituting a complete sequential scan thereof, and reply signals are sequentially supplied according to the status of each protection zone in response to the respective sequential interrogation signals, the improvement comprising: means for receiving said reply signals and generating for each of the protection zones a pattern of said reply signals for at least four of the most recent ones of said complete sequential scans of said zones; and means responsive to said reply signal patterns for determining and indicating therefrom the status of each particular protection zone, said zone status determining and indicating means indicating a change in status of one of said zones only when the entire pattern of the associated one of said reply signal patterns indicates a change in status whereby to substantially eliminate the effect of spurious signals on said system.

2. An improvement as recited in claim 1 wherein each of said reply signals is generated in the time interval between the one of said interrogation signals to which it is responding and the next successive one of said interrogation signals.

3. An improvement as recited in claim 2 further including means for synchronizing the operation of said system at the end of and at least once during each of said complete sequential scans of said zones whereby to further reduce the effect of spurious signals on said system.

4. Apparatus for monitoring the status of a plurality of zones, each of said zones having a different numerical assignment between the numbers 1 and n, said apparatus comprising:

a plurality of transponder means equal in number to the number of said zones, each of said transponder means being associated with one of said zones and being operable to count interrogation signals received, each of said transponder means being operable in response to a reset signal to set its count to 0 and being operable upon counting a number of interrogation signals equal to the numerical assignment of the one of said zones with which it is associated to generate a reply signal corresponding to the status of said associated one of said zones;

means for repeatedly generating a series of n number of said interrogation signals followed by said reset signal and transmitting same to said transponder means whereby each said series of interrogation signals followed by said reset signal constitutes a complete sequential scan of said zones, said interrogation signal generating means being operable during the generation of each of said series of interrogation signals to generate after a selected number of said interrogation signals less than *n* have been generated a count set signal and to transmit same to said transponder means, each of said transponder means being operable in response to said count set signal to set its count to said selected number whereby to reduce any effect of spurious signals on said apparatus;

means for receiving said reply signal from said transponder means and generating for each of said zones a pattern of said reply signals for a plurality of the most recent ones of said complete sequential scans of said zones, said reply signal patterns being generated from at least four of said complete sequential scans of said zones;

electrical conductor means for transmitting DC pulses interconnecting said transponder means, interrogation signal generating means and reply signal receiving means;

said interrogation, reset, reply and count set signals all being DC pulses;

means responsive to said reply signal patterns for generating for each of said zones a condition signal indicative of the status thereof, said condition signal generating means being operable to generate a condition signal indicating a different status only when the entire pattern of the associated one of said reply signal patterns indicates a change in status whereby to substantially eliminate the effect of spurious signals on said apparatus.

5. The apparatus defined in claim 4, including means responsive to said condition signals for generating for each of said zones a change of status output signal whenever same occurs.

6. The apparatus defined in claim 5, including: means for assigning relative priorities to each of said zones and displaying for an operator whenever more than one of said change of status signals are simultaneously present the one of said change of status signals associated with the one of said zones assigned highest priority; and, means for selectively resetting said change of status signal generating means with regard to any one of said zones to a no output status so that an operator once noting a change of status of a particular one of said zones can thereby free said display means so that said change of status signal associated with the one of said zones next having priority can be displayed and brought to the operator's attention.

7. The invention defined in claim 6, wherein:

said reply signal pattern generating means is operable to generate for each of said zones from four of said scans a first pattern indicative of a set status, a second pattern indicative of an alarm status and a third pattern indicative of an out of service status; and, said condition signal generating means is operable to generate for each of said zones in response to said first, second and third reply signal patterns, respectively, a condition signal indicative of normal, alarm and out of service status.

8. The invention defined in claim 7, wherein each of said reply signals is generated in the time interval between the one of said interrogation signals to which it is responding and the next successive one of said interrogation signals.

9. The invention defined in claim 8, including means responsive to said condition signals for storing information indicative of the status of said zones, said storing means being selectively operable on command to output the information associated with any specific one of said zones.

10. The invention defined in claim 9, including printer means reponsive to said information outputted by said storing means to provide a written record of the status of said zones.

11. The invention defined in claim 9, wherein:

said storing means is responsive to each of said change of status signals to output the information associated with the one of said zones with which said change of status signal is associated and in the order of said zone's assigned priority whenever more than one of said change of status signals are simultaneously present; and including:

printer means responsive to said information outputted by said storing means to provide a written record of the status of said zones and changes in status thereof.

12. The invention defined in claim 4 wherein:

said reply signal pattern generating means is operable to generate for each of said zones from said plurality of sequential scans of said zones a first pattern indicative of a set status, a second pattern indicative of an alarm status and a third pattern indicative of an out of service status; and, said condition signal generating means is operable to generate for each of said zones in response to said first, second and third reply signal patterns, respectively, a condition signal indicative of normal, alarm and out of service status.

13. The invention defined in claim 4, wherein each of said reply signals is generated in the time interval between the one of said interrogation signals to which it is responding and the next successive one of said interrogation signals.

14. The invention defined in claim 4 including means responsive to said condition signals for storing information indicative of the status of said zones, said storing means being selectively operable on command to output the information associated with any specific one of said zones.

15. The invention defined in claim 6, including:

means responsive to said condition signals for storing information indicative of the status of said zones, said storing means being responsive to each of said change of status signals to output the information associated with the one of said zones with which said change of status signal is associated and in the order of said zone's assigned priority whenever more than one of said change of status signals are simultaneously present; and, printer means responsive to said information outputted by said storing means to provide a written record of the status of said zones and changes in status thereof.

* * * * *